US007560217B2

(12) United States Patent
Obata et al.

(10) Patent No.: US 7,560,217 B2
(45) Date of Patent: Jul. 14, 2009

(54) METHOD OF FORMING ELECTROPHOTOGRAPHIC PHOTORECEPTOR AND METHOD OF DRYING COATING FILM

(75) Inventors: Takatsugu Obata, Nara (JP); Akihiro Kondoh, Nara (JP); Junichi Washo, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 469 days.

(21) Appl. No.: 11/296,251

(22) Filed: Dec. 8, 2005

(65) Prior Publication Data

US 2006/0127796 A1 Jun. 15, 2006

(30) Foreign Application Priority Data

Dec. 9, 2004 (JP) ..... P2004-357151

(51) Int. Cl.
*G03G 5/00* (2006.01)
*B05D 3/02* (2006.01)

(52) U.S. Cl. ..... 430/130; 427/541; 427/542; 427/372.2

(58) Field of Classification Search ..... 430/130; 427/541, 542, 372.2
See application file for complete search history.

(56) References Cited

U.S. PATENT DOCUMENTS 4,972,569 A 11/1990 Aoki et al.
6,096,470 A * 8/2000 Fuller et al. ..... 430/132
6,322,945 B1 * 11/2001 Nakabayashi et al. ..... 430/133
6,713,736 B2 3/2004 Suzuki et al.
2004/0253452 A1 * 12/2004 Ogino ..... 428/411.1

FOREIGN PATENT DOCUMENTS

| | | |
|---|---|---|
| EP | 0 456 829 | 11/1991 |
| JP | 58-102238 | 6/1983 |
| JP | 61-277958 | 12/1986 |
| JP | 2-72366 A | 3/1990 |
| JP | 3-233885 | 10/1991 |
| JP | 03-284375 | 12/1991 |
| JP | 04-198938 | 7/1992 |
| JP | 5-232717 A | 9/1993 |

(Continued)

OTHER PUBLICATIONS

WO 89/05198, published Jun. 15, 1989 (listed above)—equivalent to U.S. Patent No. 4,972,569 (listed above).

*Primary Examiner*—John L Goodrow
(74) *Attorney, Agent, or Firm*—Nixon & Vanderhye P.C.

(57) ABSTRACT

A method of forming an electrophotographic photoreceptor capable of forming a smooth coating film free of pinholes, bubbles, surface unevenness, etc. in a short time as a coating film for forming a photosensitive layer is provided. The method includes heating and drying a coating film formed by coating a coating solution containing ingredients of the photosensitive layer and a solvent medium containing 30% by weight or more of a solvent having a relative evaporation rate of less than 1.7 represented by the following formula (1) in an air stream at a temperature of 50° C. or higher and 130° C. or lower supplied from a blowing nozzle, by a far infrared ray heating method and an induction heating method, by using, for example, a drying apparatus, thereby manufacturing the electrophotographic photoreceptor:

(relative evaporation rate)=(time for evaporating n-butyl acetate)/(time for evaporating solvent) (1).

4 Claims, 4 Drawing Sheets

FOREIGN PATENT DOCUMENTS

| | | | |
|---|---|---|---|
| JP | 6-55129 | A | 3/1994 |
| JP | 07-195020 | | 8/1995 |
| JP | 8-332434 | A | 12/1996 |
| JP | 9-114111 | | 5/1997 |
| JP | 10-239868 | A | 9/1998 |
| JP | 11-24292 | | 1/1999 |
| JP | 11-311871 | | 11/1999 |
| JP | 2003-140371 | A | 5/2003 |
| JP | 2003-275670 | | 9/2003 |
| JP | 2004-113943 | A | 4/2004 |
| JP | 2005-43807 | | 2/2005 |
| WO | WO 89/05198 | | 6/1989 |

* cited by examiner

METHOD OF FORMING ELECTROPHOTOGRAPHIC PHOTORECEPTOR AND METHOD OF DRYING COATING FILM

BACKGROUND OF THE INVENTION

1. Field of the Invention

The present invention concerns a method of forming an electrophotographic photoreceptor and a method of drying a coating film.

2. Description of the Related Art

An electrophotographic photoreceptor for use in image forming apparatus such as copying machines, printers and facsimile units (hereinafter simply referred to as a photoreceptor) is formed by coating an organic photosensitive layer to the outer circumferential surface of a hollow cylindrical conductive substrate. Development has been made to electrophotographic photoreceptors for coping with a demand for higher performance and most of them have a laminate structure formed by laminating an undercoat layer, a charge generating layer, a charge transporting layer, a protective layer, etc. In the invention, a layer including the undercoat layer, the charge generating layer, the charge transporting layer, and the protective layer is generally referred to as a photosensitive layer. Since the undercoat layer and the protective layer are disposed for improving the performance of the electrophotographic photoreceptor and not always necessary, a layer comprising two layers of a charge generating and a charge transporting layer, or a layer in which the charge generating layer and the charge transporting layer are constituted as a single layer is also referred to as the photosensitive layer.

As the image forming method using the electrophotographic photoreceptor, the following electrophotographic image forming method utilizing the photoconductive phenomenon of the photoreceptor is used generally. At first, the photoreceptor is placed in a dark place and, after uniformly charging the surface of the photoreceptor by charging means, exposure corresponding to image information is applied to selectively discharge the surface charges in the exposed area. This results in a state where surface charges are remained only in the not-exposed area of the photoreceptor and difference is caused between the amount of surface charges in the exposed area and the amount of surface charges in the not-exposed area, to form electrostatic latent images. Then, fine colored charged particles referred to as a toner are deposited to the formed electrostatic latent images, for example, by electrostatic attraction to form toner images as visible images. The formed toner images are transferred optionally on a transfer material such as paper and then fixed to form images.

The photoreceptor used in the image forming apparatus of forming images by way of the series of electrophotographic processes described above is required, as basic characteristics, that it is excellent in electric characteristics, for example, it is excellent in the charge retainability, causes less discharges in the dark place, is excellent in the photosensitivity and discharges static charges rapidly by irradiation of light. Further, it is also required for the photoreceptor that the electric characteristics described above are stable even after repetitive use so that uniform images can be formed for a long period of time (repetitive stability), the electric characteristics are stable so that uniform images can be formed irrespective of the change of temperature and humidity (circumstantial stability), etc. In order to improve the repetitive stability and the circumstantial stability, it is necessary to improve the durability against electrical and mechanical external forces.

Durability against the electrical and mechanical external force includes, for example, durability against degradation of a surface layer caused by deposition of active substances such as ozone and $NO_x$ (nitrogen oxide) generated by corona discharge during charging, and wear resistance against wear and damages caused by the transfer material such as paper upon transfer and they are determined, particularly, depending on the surface state of the uppermost surface layer. For example, in a case where the surface state is not smooth but includes unevenness, frictional force during transfer increases in the portion of the surface layer to result in a problem such as occurrence of surface damages to lower the durability against the mechanical external force. Further, in a case where voids are present in the surface layer, for example, a surface area on which the active substances generated are deposited during charging increases to deteriorate the durability against the external electric force. Accordingly, it is indispensable to smooth the uppermost surface layer of the photoreceptor in order to improve the repetitive stability and the circumstantial stability.

An electrophotographic photoreceptor is manufactured by way of a coating step of coating a coating solution in which ingredients of a photosensitive layer such as an organic functional material, a binder resin, etc. is dissolved or dispersed in a solvent medium by way of a spraying method, wring coating method, roll coating method, blade method or dipping method on a conductive substrate at a uniform thickness (the coating solution coated on the conductive substrate is hereinafter referred to as a coating film), and a drying step of drying the coating film thereby removing the solvent contained in the coating film. Existent drying step has been conducted so far by a batch system of loading a predetermined number of conductive substrates each formed with a coating film in an in oven that blows a hot blow at a temperature higher than the boiling point of the solvent medium and drying them or a continuous system of passing an electroconductive substrate formed with a coating film in a heat treating furnace in which a plurality of heaters are disposed.

However, in a case of drying the coating film by the hot blow or the heater and the like as described above, the surface of the coating film results in a portion where the heat from the hot blow or the heater is directly applied and a portion where the heat is applied indirectly to cause unevenness in the heating to the surface of the coating film to result in unevenness also on the surface state of the coating film after drying. Further, the surface of the coating film is dried prior to the inside of the coating film and the surface forms an extremely dense hardened film by the hardening under drying. In the hardened film, a gas of the solvent inside the coating film which is evaporated by heating is difficult to escape from the surface of the coating film to sometimes result in drawbacks such as occurrence of bubbles or pinholes at the surface and in the inside of the coating film or flicking of the coating film tending to peel the coating film coated on the upper layer to the coating film surface. Since, such defects, if any, on the surface layer of the photoreceptor tend to cause cracking or peeling to deteriorate the durability against the external electrical and the mechanical force, favorable repetitive stability and circumstantial stability can not be obtained.

Further, since the hardened film makes the solvent gas inside the coating film less escaping from the surface of the coating film, this makes the drying time extremely long for the inside of the coating film. For example, it takes from one to several hours for drying the coating film having the hardened film by the hot blow, heater or the like. When it takes a long time for drying as described above, a large-scale continuous drying furnace or batch type oven is necessary in the production line in order to produce the photoreceptors in a great amount, as well as it takes a much cost for the operation and the control thereof. On the contrary, in a case where the drying time is shortened in order to solve such problems, the solvent medium remains inside the coating film to deteriorate the electric characteristics.

As a method of solving such problems, there have been proposed a method of using an far infrared heater and drying the coating film under heating by absorption of infrared rays to constituent materials per se of the coating film (refer, for example, to Japanese Unexamined Patent Publication JP-A 3-233885(1991), Japanese Examined Patent Publication JP-B2 5-50742(1993), and Japanese Unexamined Patent Publication JP-A 11-311871(1999)), a method of using radio frequency or induction heating and drying the coating film under heating by vibrating the molecules in the constituent material of the coating film (refer, for example, to Japanese Unexamined Patent Publication JP-A 58-102238(1983)), a method of heating a metal conductive substrate by induction heating and drying the film by the heat generation from the conductive substrate (refer, for example, to Japanese Unexamined Patent Publication JP-A 2003-275670), etc.

Since the drying methods for the coating film disclosed in JP-A 3-233885, JP-B2 5-50742, JP-A 11-311871, JP-A 58-102238 and JP-A 2003-275670 are methods of directly heating the coating material itself or indirectly heating to dry the inside of the coating film by heating the conductive substrate, it is described that the unevenness of heating can be decreased. Further, it is described that since the coating film can be dried from the inside and the hardened film is less formed to the surface of the coating film by such methods, the inside of the coating film can also be dried by removing the solvent medium therefrom and the drying time can be shortened.

However, in the drying methods described above, the heat efficiency is extremely higher compared with the heating method by the hot blow, heater or the like and the temperature of the coating film is sometimes increased abruptly, making it difficult to control the temperature of the coating film. In a case where the temperature of the coating film increases abruptly, this result in problems that the temperature of the coating film increases to higher than the heat resistant temperature of the photoreceptor to deteriorate the electric characteristics of the photoreceptor the coating film is heated to a temperature exceeding the boiling point of the solvent medium to generate a great amount of bubbles. Further, since the object of the direct heating in the heating method described above is a coating film or a conductive substrate, the temperature in the atmosphere at the periphery of the coating film rises only by the temperature rise of the coating film or the conductive substrate. Accordingly, when the temperature of the coating film rises abruptly described above, the temperature rise of the atmosphere can not follow the temperature rise of the coating film and the difference of the temperature between the atmosphere and the coating film becomes excessive. The gas of the solvent evaporated inside the coating film stagnates near the surface of the coating film in the process where the gas tends to escape from the surface of the coating film. In a case where the temperature difference increases between the coating film and the atmosphere, the stagnating gas of the solvent medium may sometimes be liquefied again upon escape from the surface of the coating film to the atmosphere thereby sometimes causing unevenness at the surface of the coating film. Further, an additional time is further required for drying the re-liquefied solvent gas, this also results in a problem of extending the drying time.

SUMMARY OF THE INVENTION

An object of the invention is to provide a method of forming an electrophotographic photoreceptor capable of forming a smooth coating film with no pinholes, bubbles, or surface unevenness as a coating film for forming the photosensitive layer in a short time, as well as a method of drying the coating film.

The invention provides a method of forming an electrophotographic photoreceptor having a conductive substrate and a photosensitive layer, comprising the steps of:

coating a coating solution containing ingredients of the photosensitive layer and a solvent medium containing one or more kinds of solvent on a conductive substrate thereby forming a coating film; and drying the formed coating film by heating by means of one or more of heating methods selected from the group consisting of a far infrared ray heating method, a microwave heating method, a dielectric heating method, and an induction heating method, in an air stream at a temperature of 50° C. or higher and 130° C. or less, wherein the solvent medium contains 30% by weight or more of a solvent having a relative evaporation rate of less than 1.7, where the relative evaporation rate of the solvent is defined as a ratio between a time for evaporating n-butyl acetate and a time for evaporating the solvent.

According to the invention, the solvent medium of the coating solution for forming the coating film contains 30% by weight or more of a solvent having a relative evaporation rate of less than 1.7, the coating film is heated and dried by means of one or more of heating methods selected from the group consisting of a far infrared ray heating method, a microwave heating method, a dielectric heating method, and an induction heating method in an air stream at a temperature of 50° C. or higher and 130° C. or less, thereby forming an electrophotographic photoreceptor having the coating film as the photosensitive layer. The drying step is conducted in an air stream at a temperature of 50° C. or higher and 130° C. or lower. By conducting the drying step in such an air stream at a temperature higher than the normal temperature, drying can be conducted in a short time by accelerating the temperature rise in the coating film in the initial stage of the drying. Further, by conducting the drying step in an air stream at a temperature lower than the temperature set for the heating of the coating film, abrupt temperature rise of the coating film can be prevented. Accordingly, it is possible to prevent the temperature rise of the coating film to higher than the heat resistant temperature of the electrophotographic photoreceptor thereby preventing degradation of the electric characteristics as the electrophotographic photoreceptor. Further, since it is possible to prevent the temperature of the coating film from rising exceeding the boiling point of the solvent medium, occurrence of bubbles, etc. can be prevented and a photographic photoreceptor having a smooth coating film as the photosensitive layer can be manufactured.

Further, since the drying step is conducted under heating by one or more of the heating methods selected from the group consisting of the far infrared ray heating method, the microwave heating method, the dielectric heating method and the induction heating method, the temperature of the coating film can be elevated in a short time in the initial stage of drying. Further, since the coating film can be dried from the inside, drying in the short time can be conducted and the hardened film is less formed on the surface of the coating film. As described above, since also the solvent medium in the inside can be removed sufficiently, degradation of the electric characteristics of the electrophotographic photoreceptor can be prevented and the coating film for forming the photosensitive layer can be dried in a short time.

Further, the solvent having the relative evaporation rate of less than 1.7 is contained by more than 30% by weight as the solvent medium in the coating solution. By using such a solvent medium, since the evaporation rate of the solvent medium in the coating solution is moderated, rapid drying of the film surface compared with the inside of the coating film can be prevented even when it is placed in an air stream at a temperature higher than the normal temperature during the coating step, in the transition from the coating step to the drying step, or in the drying step and formation of the hardened film at the surface of the coating film can be prevented.

As described above, an electrophotographic photoreceptor having a smooth coating film as a coating film for forming the photosensitive layer can be manufactured in a short time.

Further, in the invention, it is preferable that the conductive substrate has a circular tubular or columnar shape, and the drying step is conducted while keeping the conductive substrate such that an axial direction thereof is in parallel with the horizontal direction and rotating the conductive substrate about the axial line.

Further, according to the invention, since the drying step is conducted while rotating a circular cylindrical or columnar conductive substrate kept such that the axis thereof is in horizontal about the axial line, it is possible to prevent the coating solution which is lowered with the viscosity due to temperature rise and increased with the fluidity from sagging in the gravitational direction along the conductive substrate by a gravitational force, so that the film thickness can be made uniform in the circumferential direction and the axial direction of the circular cylindrical or columnar-shape conductive substrate. Further, in a case of heating, for example, by the far infrared ray method, while a portion not applied with the far infrared ray is not heated, since the circular cylindrical or columnar shape conductive substrate is rotated about the axis thereby capable of preventing the occurrence of unevenness in the heating and capable of reducing the unevenness on the surface of the coating film after drying.

Further, in the invention, it is preferable that one or more of factors selected from the group consisting of heating output by the heating method, the temperature of an air stream, and an blowing amount of the air stream is controlled in accordance with the temperature of the coating film.

Further, according to the invention, since the heating output by the heating method, the temperature of the air stream and the blowing amount of the air stream are controlled in accordance with the temperature of the coating film, the temperature control for the coating film is facilitated. Specifically, till the temperature of the coating film reaches a predetermined temperature, that is, a temperature as high as possible within a range lower than the heat resistant temperature of the electrophotographic photoreceptor or the boiling point of the solvent, which is lower, the heating output by the heating method is increased as much as possible and the temperature of the air stream is increased to shorten the time till it reaches the predetermined temperature. Once the temperature of the coating film reaches the predetermined temperature, the heating output is decreased to less than that in the initial stage so that the temperature of the coating film does not exceed the predetermined temperature to lower the temperature of the air stream. The blowing amount of the air stream is properly controlled in accordance with the temperature of the air stream. By controlling the heating output, the temperature air stream and the blowing amount of the air stream as described above, it is possible to prevent excess temperature rise of the coating film and shorten the time required for drying.

Further, the invention provides a method of drying a coating film formed by coating a coating solution containing ingredients for the coating film and a solvent medium containing over one or more kinds of a solvent on a substrate, comprising the step of;

drying the formed coating film by heating by means of one or more of heating methods selected from the group consisting of an far infrared ray heating method, a microwave heating method, a dielectric heating method, and an induction heating method in an air stream at a temperature of 50° C. or higher and 130° C. or less, wherein the solvent medium contains 30% by weight or more of a solvent having a relative evaporation rate of less than 1.7, where the relative evaporation rate of the solvent is defined as a ratio between a time for evaporating n-butyl acetate and a time for evaporating the solvent.

Further, according to the invention, the solvent medium of the coating solution forming the coating film contains 30% by weight or more of a solvent having the relative evaporation rate of less than 1.7, and the coating film is dried being heated by one or more of heating methods selected from the group consisting of the far infrared ray heating method, the microwave heating method, the dielectric heating method, and the induction method in an air stream 50° C. or higher and 130° C. or lower. Accordingly, the time required for drying can be shortened as described above and a smooth coating film with no unevenness on the surface can be formed as a dried coating film on the substrate.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
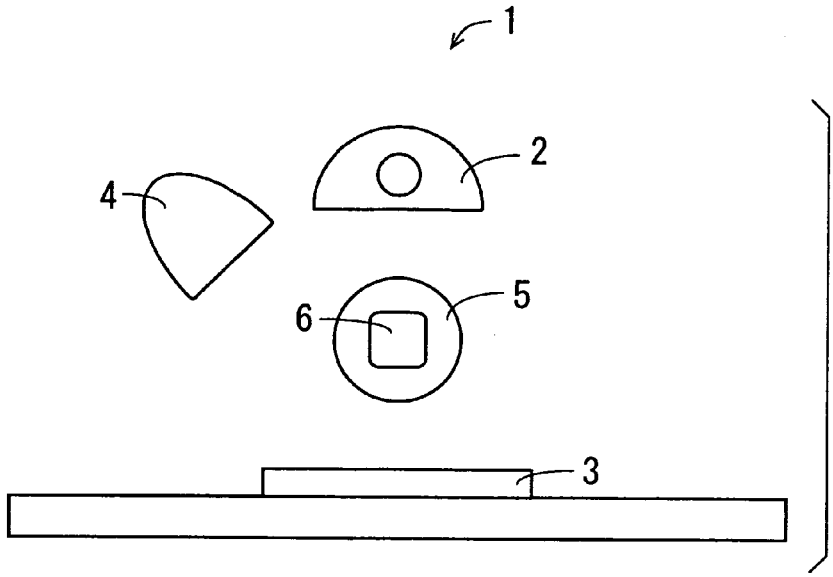
FIG. 1 is a side elevational view schematically showing the constitution of a drying apparatus used for the method of forming a photoreceptor in the invention.

Now referring to the drawings, preferred embodiments of the invention are described below.

The electrophotographic photoreceptor (hereinafter also referred to simply as a photoreceptor) includes a conductive substrate and a photosensitive layer. The photoreceptor is manufactured by way of the steps of coating a coating solution in which ingredients for the photosensitive layer such as an organic functional material and a birder resin are dissolved or dispersed in a solvent medium on a conductive substrate at a uniform thickness and drying the solvent medium contained in the coated coating solution. In the invention, the coating solution coated on the conductive substrate is referred to as a coating film. Further, entire liquid having a property capable of dissolving or dispersing the ingredients of the photosensitive layer such as the organic functional material and the binder resin is referred to as a solvent medium and one or more substances constituting the solvent medium is referred to as a solvent.

The method of forming the photoreceptor according to the invention includes the steps of coating a coating solution containing ingredients of the photosensitive layer and a solvent medium on a conductive substrate thereby forming a coating film, and drying the formed coating film by heating by means of one or more of heating methods selected from the group consisting of the far infrared ray heating method, the microwave heating method, the dielectric heating method, and the induction heating method in an air stream at a temperature of 50° C. or higher and 130° C. or less, wherein the solvent medium contains 30% by weight or more of a solvent having a relative evaporation rate of less than 1.7, assuming the ratio between the time for evaporating n-butyl acetate and a time for evaporating the solvent being as the relative evaporation rate of the solvent.

The electrophotographic photoreceptor has a lamination structure formed by laminating an undercoat layer, a charge generating layer, a charge transporting layer, a protective layer, etc. In the invention, a layer constituted with the undercoat layer, the charge generating layer, the charge transporting layer and the protective layer is generally referred to as a photosensitive layer. Since the undercoat layer and the protective layer are disposed for improving the performance of the electrophotographic photoreceptor and not always necessary, a layer comprising two layers of a charge generating and a charge transporting layer, or a layer in which the charge generating layer and the charge transporting layer are constituted as a single layer is also referred to as the photosensitive layer.

The electrophotographic photoreceptor manufactured by the forming method according to the invention is not particularly restricted and various modifications are possible. In such a photoreceptor, for example, a charge generating layer and a charge transporting layer may be formed on the conductive substrate, or an undercoat layer is formed on a conductive substrate and a charge generating layer and a char-e transporting layer may be formed thereover, or a protective layer may be formed on the charge generating layer and the charge transporting layer.

The photoconductive substrate of the photoreceptor that can be manufactured by the forming method according to the invention, the ingredients for the photosensitive layer for forming each of the layers of the photosensitive layer and the coating solution are to be described below.

As the conductive substrate, metal materials, for example, aluminum, aluminum alloy, copper, zinc, stainless steel and titanium can be used. The conductive substrate is not limited to such metal materials but those formed by laminating a metal foil or vapor depositing a metal material, vapor depositing or coating layer of a conductive compound such as conductive polymer, tin oxide, indium oxide, carbon particles and metal particles on the surface of a polymeric material such as polyethylene terephthalate, polyester, polyoxymethylene, and polystyrene, hard paper and glass can also be used. However, in a case of using at least the induction heating as the heating source, the metal material is most suitable. Further, the surface of the conductive substrate may be applied, optionally, with an anodizing treatment, a surface treatment with chemicals or hot water, a coloring treatment or a random reflection treatment such as surface roughening within a range not giving undesired effects on the quality of the formed images upon use as the photoreceptor. In the electrophotographic process using a laser light as an exposure light source, since the wavelength of the incident laser light is coherent, the incident laser light and the light reflected on the electrophotographic photoreceptor may sometimes cause interference and the interference fringe by the interference appears on the images to resulting image defects. By applying the random reflection treatment described above to the surface of the conductive substrate, it is possible to prevent image defects caused by the interference of the laser light of coherent wavelength.

The photosensitive layer including such as a charge generating layer, a charge transporting layer, an undercoat layer and a protective layer is formed by the steps of coating a solvent medium, as a coating solution, in which each of ingredients of the photosensitive layer is dispersed or dissolved on a conductive substrate. Each of the layers, after being formed by the coating step is optionally subjected to the drying step. The drying step is to be described below.

The charge generating layer contains a charge generating substance which generates electric charges by absorption of light as a main ingredient. The charge generating substance includes, for example, azo pigments such as mono azo pigments, bis azo pigments and tris azo pigments, indigo pigments such as indigo and thio indigo, perylene pigments such as perylene imide and perylenic acid anhydride, polycyclic quinone pigments such as anthraquinone, and pyrene quinone, phthalocyanine pigments such as metal phthalocyanine and non metal phthalocyanine, triphenyl methane dyes such as methyl violet, crystal violet, night blue, and Victoria blue, acrydine dyes such as erythrosine, rhodamine B, rhodamine 3R, acrydine orange, and flaveosine, thiadine dyes such as methylene blue and methylene green, oxadine dyes such as capryl blue and meldra's blue, various organic pigments and dyes such as squarylium dyes, pyrilium salts, thiopyrilium salts, thioindigo dyes, bisbenzoimidazole dyes, quinacridone dyes, quinoline dyes, lake dyes, azo lake dyes, dioxadine dyes, azulenium dyes, triallylmethane dyes, xanthene dyes, and cyanine dyes, inorganic materials such as amorphous silicon, amorphous selenium, tellurium, selenium-tellurium alloys, cadmium sulfide, antimony sulfide, zinc oxide, and zinc sulfide. Those charge generating substances may be used alone or two or more of them may be used in combination.

The charge generating layer is formed by coating, on a conductive substrate or an undercoat layer, a coating solution for forming the charge generating layer obtained by dissolving or dispersing a charge generating substance in a solvent, among all, a coating solution obtained by dispersing a charge generating substance in a binder resin solution obtained by dissolving or mixing a binder resin as a binder in a solvent medium by a known method.

As the binder resin to be used in the coating solution for forming the charge generating layer, there can be used a resin selected from the group consisting of resins such as polyester resins, polystyrene resins, polyurethane resins, phenol resins, alkyd resins, melamine resins, epoxy resins, silicone resins, acrylic resins, methacrylic resins, polycarbonate resins, polyallylate resins, phenoxy resins, polyvinyl butyral resins, polyvinyl formal resins, and copolymer resins containing two or more repeating units constituting the resins described above. They may be used each alone or two or more of them may be used in combination. The copolymer resins include, for example, insulative resins such as vinyl chloride-vinyl acetate copolymer resin, vinyl chloride-vinyl acetate-maleic acid anhydride copolymer resin, and acrylonitrile-styrene copolymer resin. The binder resins are not restricted to those described above, but known resins which are used generally can be used.

A solvent to be used for the solvent medium capable of dissolving or dispersing the charge generating substance and the binder resin includes, for example, halogenated hydrocarbons such as 1,3-dichloropropane and trichloroethane, ketones such as isophorone, methyl ethyl ketone, acetophenone, cyclohexanone and isophorone, esters such as ethyl acetate, methyl benzoate, and n-butyl acetate, ethers such as tetrahydrofuran, 1,4-dioxane, and dibenzylether, 1,2-dimethoxyethane, aromatic hydrocarbons such as benzene, toluene, xylene, mesitylene, tetralin, diphenyl methane, dimethoxy benzene, and dichlorobenzene, sulfur-containing solvents such as diphenyl sulfide, fluorine-based solvents such as hexafluoro isopropanol, glime solvents such as ethylene glycol monobutyl ether, and diethylene glycol monobutyl ether, aprotic polar solvents such as N,N-dimethyl formamide and N,N-dimethyl acetoamide. Such solvents may be used each alone or two or more of them may be used as a mixed solvent.

Assuming the weight of the charge generating layer in total as 100%, the blending ratio between the charge generating substance and the binder resin is, preferably, within a range from 10% by weight or more and 99% by weight or less. In a case where the charge generating substance is less than 10% by weight, the sensitivity of the photoreceptor may possibly be lowered. In a case where the charge generating substance is more than 99% by weight, not only the strength of the charge generating layer is lowered, but also the dispersibility of the charge generating substance is lowered, so that coarse particles are increased, and the surface charges at portions other than the portions which are to be erased by exposure of light are reduced, to generate a large number of image defects, particularly, image fogging, so-called black spots where a toner is deposited on the white background and fine black dots are formed As a pretreatment to disperse the charge generating substance in the binder resin solution, the charge generating substance may be pulverized previously by a pulverizer. The pulverizer to be used for the pulverization includes, for example, a ball mill, a sand mill, an attritor, a vibration mill, and a supersonic dispersing equipment. As the dispersion conditions in this case, it is desirable to select appropriate conditions so as not to intrude impurities caused by wear of members constituting the container and the dispersing equipment to be used.

Further, various additives such as a hole transporting substance, an electron transporting substance, an antioxidant, a dispersion stabilizer, a sensitizer and the like may optionally be added to the charge generating layer. This can improve the potential characteristic and the stability as a coating solution. Further, the fatigue degradation which occurs when the electrophotographic photoreceptor is used repetitively can be mitigated to thereby improve the durability.

The method of coating the coating solution for forming the charge generating layer includes, for example, a spray method, a wring coating method, a roll coating method, a blade method, and a dipping method.

The film thickness of the charge generating layer is, preferably, from 0.05 μm or more and 5 μm or less and, more preferably, from 0.1 μm or more and 1 μm or less. In a case where the film thickness of the charge generating layer is less than 0.05 μm, the efficiency of the light absorption may be lowered to thereby possibly reduce the sensitivity of the photoreceptor. In a case where the film thickness of the charge generating layer exceeds 5 μm, transfer of the charges in the inside of the charge generating layer becomes the rate determining step upon elimination of the charges on the surface of the electrophotographic photoreceptor, to possibly lower the sensitivity.

The charge transporting layer is obtained by incorporating a charge transporting substance which accepts and transports the charges generated in the charge generating substance in the binder resin. The charge transporting layer is not limited to one layer but can be constituted as two or more layers. When such a multiple layer constitution is adopted, separate layers can share the functions required for the charge transporting layer, so that the range of the materials to be used can be extended compared with a case of constituting the charge transporting layer by one layer. Further, since it is scarcely necessary to consider the compatibility of various kinds of materials in one layer, photoreceptors of high performance can be provided easily.

For the charge transporting substance, hole transporting substances and electron transporting substances can be used. The hole transporting substances include, for example, carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acrydine derivatives, phenazine derivatives, aminostilbene derivatives, triarylamine derivatives, triarylmethane derivatives, phenylene diamine derivatives, stilbene derivatives, enamine derivatives, and benzidine derivatives. They also include polymers having a group derived from those compounds in the main chain or on the side chain, for example, poly-N-vinyl carbazole, poly-1-vinylpyrene, ethylcarbazole-formaldehyde resin, triphenylmethane polymers, poly-9-vinyl anthracene and polysilane.

The electron transporting substance include, for example, organic compounds such as benzoquinone derivatives, tetracyano ethylene derivatives, tetracyano quinodimethane derivatives, fluorenone derivatives, xanthone derivatives, phenanethraquinone derivatives, phthalic anhydride derivatives, and diphenoquinone derivatives, and inorganic materials such as amorphous silicon, amorphous selenium, tellurium, selenium-tellurium alloy, cadmium sulfide, antimony sulfide, zinc oxide and zinc sulfide. The charge transporting substances are not limited to those described above, and may be used each alone or two or more of them may be used in admixture.

Similar to the charge generating layer, the charge transporting layer is formed by coating, on a charge generating layer, a coating solution for forming the charge transporting layer obtained by dissolving or dispersing the charge transporting substance in a solvent and, particularly, a coating solution obtained by dissolving or dispersing the charge transporting substance in a binder resin solution obtained by dissolving or mixing a binder resin as a binder agent in a solvent medium by a known method.

For the binder resin of the charge transporting layer, those excellent in the compatibility with the charge transporting substance are selected. The binder resin includes, for example, polymethyl methacrylate resins, polystyrene resins, vinyl polymer resins such as polyvinyl chloride resin and copolymer resins thereof, polycarbonate resins, polyester resins, polyester carbonate resins, polysulfone resins, phenoxy resins, epoxy resins, silicone resins, polyallylate resins, polyamide resins, methacryl resins, acryl resins, polyether resins, polyurethane resins, polyacrylamide resins, and phenol resins. In addition, thermosetting resins prepared by partially crosslinking the resins described above may also be used. Such resins may be used each alone, or two or more of them may be used in admixture. Among the resins described above, polystyrene resins, polycarbonate resins, polyallylate resins or polyphenylene oxide are particularly preferred since they are excellent in electric insulating property having a volumic resistance value of $10^{13}$ Ω or more and also excellent in the film forming property, and electric characteristics.

The ratio (B/A) of the weight of the binder resin (B) to the weight of the charge transporting substance (A) is preferably 12/10 or more and 30/10 or less (=1.2 or more and 3.0 or less). In a case where the ratio of the binder resin content is increased such that the ratio (B/A) exceeds 30/10 (=3.0), the viscosity of the coating solution for forming the charge transporting layer is increased, to lower the coating speed and possibly worsen the productivity greatly. Further, in a case where the amount of the solvent in the coating solution for forming the charge transporting layer is increased for suppressing the increase of the viscosity, a brushing phenomenon of causing clouding in the charge transporting layer occurs. While on the other hand, in a case where the ratio (B/A) is less than 12/10 (=1.2), and the ratio of the binder resin is lowered, printing resistance is lowered compared with a case where the ratio of the binder resin is high, so that the wear amount of the charge transporting layer is increased, to shortens the endurance lifetime. However, in a case where the charge transporting layer is composed of multiple layers, the ratio may be changed optionally depending on the function shared by each layer.

Additives such as a plasticizer and a surface modifier may be added optionally to the charge transferring layer in order to improve the film forming property, the flexibility and the surface smoothness. The plasticizer includes, for example, biphenyl, biphenyl chloride, benzophenone, o-terphenyl, dibasic acid ester, fatty acid ester, phosphoric acid ester, phthalic acid ester, various kinds of fluorohydrocarbons, chlorinated paraffin, and epoxy plasticizers. The surface modifier includes, for example, silicone oil and fluorine resins.

In order to enhance the mechanical strength and improve the electric characteristics, fine particles of an inorganic compound or an organic compound may be added to the charge transporting layer. Further, various kinds of additives such as an antioxidant and a light stabilizer may be added. This can mitigate the degradation of the charge transporting layer due to deposition of active substances such as ozone, $NO_x$, etc., generated upon charging, and the durability of the electrophotographic photoreceptor during repetitive use can be improved. Further, this enhances the stability of the coating solution for forming the charge transferring layer to extend the solution lifetime and, in addition, an electrophotographic photoreceptor manufactured with the use of the coating solution is improved since impurities are decreased.

As the antioxidant and the light stabilizer, hindered phenol derivatives or hindered amine derivatives are preferably used. The hindered phenol derivative is used, preferably, at a weight ratio within a range of 0.001 or more and 0.10 or less based on the weight of the charge transporting substance. The hindered amine derivative is used, preferably, at a weight ratio within a range of 0.001 or more and 0.10 or less based on the weight of the charge transporting substance. Further, the hindered phenol derivative and the hindered amine derivative may be used in admixture. In this case, it is preferred that the total amount of the hindered phenol derivative and the hindered amine derivative to be used is at a weight ratio within a range of 0.001 or more and 0.10 or less based on the weight of the charge transporting substance.

In a case where the amount of the hindered phenol derivative to be used or the amount of the hindered amine derivative to be used, or the total amount of the hindered phenol derivative and the hindered amine derivative to be used is less than 0.001 based on the weight ratio relative to the weight of the charge transporting substance, no sufficient effect of improving the stability of the coating solution for forming the charge transporting layer and improving the durability of the photographic photoreceptor can be developed. While on the other hand, in a case where the weight ratio more than 0.10 undesired effects are caused to the electric characteristics of the photoreceptor.

The charge transporting layer is formed by dissolving or dispersing the charge transporting substance, the binder resin and, optionally, the additive described above in a solvent medium comprising an appropriate solvent to prepare the coating solution for the charge transporting layer, and coating the coating solution on the charge generating layer by a spray method, wring coating method, roll coating method, blade method or dipping method. Then the formed coating film is immediately subjected to a drying step, and then optionally provided with a protective layer, to obtain an electrophotographic photoreceptor.

The solvent to be used for the solvent medium of the coating solution for forming the charge transporting layer includes, for example, aromatic hydrocarbons such as benzene, toluene, xylene, mesitylene, tetralin, diphenyl methane, dimethoxy benzene, and dichlorobenzene, halogenated hydrocarbons such as dichloromethane, 1,3-dichloropropane, and trichloroethane, ethers such as tetrahydrofuran, 1,4-dioxane, dibenzyl ether, and dimethoxymethyl ether, ketones such as cyclohexanone, acetophenone, and isophorone, esters such as methyl benzoate and butyl acetate, sulfur-containing solvents such as diphenylsulfide, fluorine type solvents such as hexafluoro isopropanol and aprotic polar solvents such as N,N-dimethyl formamide. They may be used each alone, or two or more of them may be used in admixture. Further, the solvent described above may be used with further addition of a solvent such as alcohols and acetonitrile.

The film thickness of the charge transporting layer is, preferably, 5 μm or more and 50 μm or less and, more preferably, 10 μm or more and 40 μm or less. In a case where the film thickness of the charge transporting layer is less than 5 μm, the charge retainability on the surface of the electrophotographic photoreceptor may possibly be lowered. In a case where the film thickness of the charge transporting layer exceeds 50 μm, the resolution of the electrophotographic photoreceptor may possibly be lowered.

In a case of a laminated type photoreceptor, a charge transporting layer may be laminated on a charge generating layer formed on a conductive substrate or, on the contrary, the charge generating layer may be laminated on the charge transporting layer formed on the conductive substrate. In a case of a mono-layered type photoreceptor, the photosensitive layer containing the charge generating substance and the charge transporting substance is formed in the same manner as in the case of forming the charge transporting layer described above. For example, it is formed by dissolving or dispersing the charge generating substance, a hole transporting substance or an electron transporting substance as the charge transporting substance and a binder resin in a solvent medium comprising an appropriate solvent described above to prepare a coating solution for the photosensitive layer, and coating the coating solution for the photosensitive layer by various kinds of coating methods described above. The film thickness of the photosensitive layer of the mono-layered type photoreceptor is, preferably, 5 μm or more and 100 μm or less and, more preferably, 10 μm or more and 50 μm or less. In a case where the film thickness of the photosensitive layer is less than 5 μm, the charge retainability on the surface of the electrophotographic photoreceptor is lowered. In a case where the film thickness of the photosensitive layer exceeds 100 μm, the productivity is lowered.

In the electrophotographic photoreceptor, an undercoat layer may be formed between the conductive substrate and the charge generating layer and the charge transporting layer as described above. By the provision of the undercoat layer, since injection of charges from the conductive substrate to the photosensitive layer can be prevented, lowering of the charge retainability of the photoreceptor can be prevented. Further, in a case of using a photoreceptor formed with the undercoat layer for forming images, since the reduction of charges on the surface at portions other than the portions where they are to be erased by exposure to light, occurrence of defects such as fogging of images can be prevented. In addition, since the surface of the conductive substrate can be smoothed by coating the defects on the surface of the conductive substrate by the undercoat layer, the film-forming property of the charge generating layer and the charge transporting layer can be enhanced. Further, the exfoliation of the charge generating layer and the charge transporting layer from the conductive substrate can be suppressed, thereby capable of improving adhesion to the conductive substrate.

The undercoat layer includes, for example, resin layers, made of various kinds of resin materials and alumite layers. The resin material for forming the resin layer includes, for example, resins such as polyethylene resins, polypropylene resins, polystyrene resins, acrylic resins, vinyl chloride resins, vinyl acetate resins, polyurethane resins, epoxy resins, polyester resins, melamine resins, polycarbonate resins, polyester carbonate resins, polysulfone resins, phenoxy resins, polyallylate resins, silicone resins, polyvinyl butyral resins, and polyamide resins, and copolymer resins containing two or more repeating units constituting those resins, casein, gelatin, polyvinyl alcohol, ethyl cellulose, etc.

Further, the undercoat layer may contain particles such as of a metal oxide. When the particles are contained, the volumic resistance of the undercoat layer is controlled, and the injection of charges from the conductive substrate to the photosensitive layer can further be suppressed, as well as the electric characteristics of the electrophotographic photoreceptor can be maintained even if the temperature, the humidity or the like changes. The particles of metal oxide include, for example, particles of titanium oxide, aluminum oxide, aluminum hydroxide, and tin oxide. When the particles of metal oxide or the like are contained in the undercoat layer, the undercoat layer can be formed by dispersing the particles in a resin solution in which the resin described above is dissolved to prepare a coating solution for forming the undercoat layer, and coating the coating solution on the conductive substrate.

As the solvent medium for the resin solution, there can be used, in addition to the organic solvents described above, water, alcohols such as methanol, ethanol, and butanol, and glime solvents such as ethylene glycol monobutyl ether and diethylene glycol monobutyl ether. A mixed solvent comprising two or more of such solvents can also be used.

A method for dispersing the metal oxide particles in the resin solution includes, for example, an ordinary method using a ball mill, sand mill, attritor, vibration mill, supersonic dispersing machine.

Assuming the weight of the total content of the resin and the metal oxide in the coating solution for forming the undercoat layer as C, and the weight of the content of the solvent in the coating solution for forming the undercoat layer as D, the ratio (C/D) of the total content C of the resin and the metal oxide to the content D of the solvent is, preferably, 1/99 or more and 40/60 or less (=0.01 or more and 0.67 or less) and, more preferably, 2/98 or more and 30/70 or less (=0.02 or more and 0.43 or less).

The ratio (E/F) of the resin content (weight E) to the metal oxide content (weight F) in the coating solution for forming the undercoat layer is, preferably, 1/99 or more and 90/10 or less (=0.01 or more and 9.0 or less) and, more preferably, 5/95 or more and 70/30 or less (0.05 or more and 2.33 or less).

The film thickness of the undercoat layer is, preferably, 0.01 μm or more and 20 μm or less and, more preferably, 0.1 μm or more and 10 μm or less. In a case where the film thickness of the undercoat layer is less than 0.01 μm, the undercoat layer does not substantially function as the undercoat layer, and no uniform surface can be obtained by covering the defects of the conductive substrate. Further, since the injection of the charges from the conductive substrate to the photosensitive layer can no more be prevented, the chargeability of the photosensitive layer lowers. In a case where the film thickness of the undercoat layer exceeds 20 μm, it is not preferred since the undercoat layer is difficult to be formed uniformly, and the sensitivity of the electrophotographic photoreceptor is lowered.

The method of coating the coating solution for forming the undercoat layer includes, for example, a spray method, and wring coating method, roll coating method, blade method and dipping method. The coating film of the undercoat layer is subjected to a drying step or subjected to a subsequent charge generation layer coating step without applying any particular drying step.

A protective layer may be provided on the outer periphery of the charge generation layer and the charge transporting layer. The provision of the protective layer can improve the wear resistant life time of the electrophotographic photoreceptor, as well as prevent undesired chemical effects on the photosensitive layer, caused by ozone, $NO_x$, etc., generated by corona discharge upon charging the surface of the electrophotographic photoreceptor.

As the protective layer, comprising, for example, curable resins, inorganic filler-containing resins, inorganic oxides are used. The resin to be used for the protective layer includes, for example, an acrylonitrile-butadiene-styrene resin, acrylonitrile-chlorinated polyethylene-styrene resin, olefin-vinyl monomer copolymer, chlorinated polyether, allyl resin, phenol resin, polyacetal, polyamide, polyamideimide, polyacrylate, polyallylsulfone, polybutylene, polybutylene terephthalate, polycarbonate, polyether sulfone, polyethylene, polyethylene terephthalate, polyimide, acryl resin, polymethyl pentene, polypropylene, polyphenylene oxide, polysulfone, polystyrene, acrylonitrile-styrene resin, butadiene-styrene copolymer, polyurethane, polyvinyl chloride, polyvinylidene chloride, and epoxy resin.

The filler to be added to the protective layer includes, for example, titanium oxide, tin oxide, zinc oxide, zirconium oxide, indium oxide, silicon nitride, calcium oxide, barium sulfate, indium-tin oxide (ITO), silica, colloidal silica, alumina, carbon black, fine fluorine resin powder, fine polysiloxane resin powder, and fine polymeric charge transporting material powder. They can be used each alone or two or more of them may be used in combination. The surface of the fillers may be treated with an inorganic material or an organic material for the reason of improving the dispersibility and modifying the surface property. A filler subjected to the water repellent treatment described above among such surface treatments includes, for example, those treated with a silane coupling agent, those treated with a flurosilane coupling agent, those treated with a fatty acid, those subjected to copoymerization with a polymeric material. Those treated with the inorganic material include, for example, fillers treated at the surface with alumina, zirconia, tin oxide, or silica.

For the purpose of transporting holes or electrons efficiently, a hole transporting substance or an electron transporting substance as the charge transporting substance described above may be added to the protective layer. Further, for the purpose of improving the chargeability, compounds in which a phenol compound, hydroquinone compound, hindered phenol compound, hindered amine compound, or hindered amine and a hindered phenol are present in one identical molecule can be added. Further, a plasticizer and/or a leveling agent can also be added. The plasticizer includes, for example, those ordinarily used for resins such as dibutyl phthalate and dioctyl phthalate can be used. The amount of the plasticizer to be used is appropriately 0.1% by weight or more and 30% by weight or less based on the amount of the resin. The leveling agent including, for example, silicone oils such as dimethyl silicone-oil, and methylphenyl silicone oil, polymers and oligomers having perfluoroalkyl groups on the side chain can be used. The amount of the leveling agent to be used is appropriately 0.001% by weight or more and 1% by weight or less based on the amount of the resin.

Further, in order to constitute the protective layer with a layer containing at least a curable resin, various crosslinking reactions known so far in the field of materials, for example, radical polymerization, ion polymerization, thermal polymerization, light polymerization, radiation polymerization or the like can be used. Further, in order to achieve a cured protective layer with low surface energy, a material having a silicone structure, a perfluoroalkyl structure, a long chained alkyl structure or the like may be subjected to crosslinking reaction by a known method.

As described above, in order to provide the protective layer with the charge transporting function together, a substance having a charge transporting function or a polymeric charge transporting substance may be subjected to crosslinking reaction. For such a protective layer, a layer comprising, for example, a polysiloxane resin prepared by mixing and curing a crosslinkable organopolysiloxane resin and a compound capable of bonding thereto and containing a structural unit having charge transportability is used thereby capable of providing a protective layer having excellent durability and electric characteristics.

The protective layer is formed by dissolving or dispersing the resin described above and, optionally, an additive such as the filler described above in a solvent medium comprising an appropriate solvent, and coating the coating solution on a charge transporting layer or the like by a spray method, wring coating method, roll coating method, blade method, dipping method or the like. Then, the formed coating film is put to a drying step.

As the solvent to be used for the solvent medium for the coating solution for forming the protective layer, there can be used, for example, alcohol solvents such as methanol, ethanol and butanol, glime solvents such as ethylene glycol monobutyl ether and diethylene glycol monobutyl ether, ethers such as tetrahydrofuran, 1,4-dioxane, and diethyl ether, aliphatic organic solvents such as hexane and heptane, aromatic organic solvents such as benzene and pyridine, and water. Among them, water, alcohols and glime solvents are preferred. They may be used each alone or two or more of them may be used in combination. In a case where the protective layer forming substance and the substance which forms the underlying layer provided below the protective layer are soluble to an identical solvent, the protective layer formed as a layer remote from the conductive substrate is preferably coated over the underlying layer by a roll coating method.

The thickness of the protective layer is, preferably, 0.5 μm or more and 5 μm or less and, more preferably, 1 μm or more and 3 μm or less. In a case where the thickness of the protective layer is less than 0.5 μm, the protective layer tends to be peeled from the boundary with the underlying layer when it undergoes external force due to contact with the blade or the charging roller. This is considered to be attributable to that when the thickness of the protective layer is small, the protective layer per se can not resist the applied external force, so that the force always exerts on the boundary with the underlying layer and in a case where it is loaded for long time, the boundary tends to cause deviation by the loaded force. Further, in a case where the thickness of the protective layer is small, the protective layer may be lost entirely by wear before reaching the lifetime of the electrophotographic photoreceptor. In a case where the thickness of the protective layer is more than 5 μm, since carriers are dispersed during transportation of them in the protective layer, thickening of letters, etc. tend to occur to possibly increase the residual potential due to lowering of the sensitivity and the repetitive use of the photoreceptor.

Further, the antioxidant and/light stabilizer to be used optionally in the charge transporting layer as described above may be contained in any of the charge generation layer, the charge transporting layer, and the protective layer, and may be contained in all of the three layers.

Each of the layers formed by being coated on the conductive substrate as described above is optionally put to the drying step. While it is desired that all of the layers formed on the conductive substrate are put to the drying step, it may suffice that one or more of selected layers are put to the drying step in view of the cost required for the drying step. The layers not put to the drying step are left to stand at a room temperature for one hour with no particular treatment, and the subsequent layer is coated.

In a case where one or more of selected layers are put to the drying step, the outermost surface layer is preferably included in selected layers. In a case where the surface of the uppermost surface layer is uneven with no smoothness, durability to the electrical and mechanical external force is lowered to result in lowering of the repetitive stability and the circumstantial stability. In a case where the outermost surface layer is the protective layer, since the protective layer is thin compared with other layers, the surface state of the protective layer tends to undergo the effect of the surface state of the layer below the protective layer. Accordingly, it is preferred that the layer below the protective layer is also put to the drying step.

The drying step of the coating film for forming the photosensitive layer of the photoreceptor is a step of conducing a treatment so that the coating film has a smooth surface by substantially evaporating all the solvent medium in the coating film coated by various kinds of coating methods while suppressing the generation of bubbles in the coating film during the step. At present, a hot blow drying furnace is frequently used for the step. However, in a case of the hot blow drying, since heat transfers from the surface of the coating film, drying is started at first from the surface of the coating film and the surface of the coating film is dried and hardened to form a hardened film. When such a dense hardened film is formed on the surface, the solvent medium evaporated in the inside of the coating film is extremely difficult to escape, and it takes an extremely long time as from one hour to several hours for the drying. Accordingly, it is required for a method capable of drying in a short period so as not to form such a hardened film.

In a case where the photosensitive layer is put to a drying step in the invention, the solvent medium used in a coating step of forming a coating film by coating on a conductive substrate a solvent having the ingredients of the photosensitive layer dispersed or dissolved therein as a coating liquid contains, among the solvents described above, 30% by weight or more of a solvent having less than 1.7 of a relative evaporation rate as a ratio between the time for evaporating n-butyl acetate and the time for evaporating the solvent, namely, the relative evaporation rate represented by the following formula (1). The relative evaporation rate is a ratio between the time for evaporating n-butyl acetate and the time for evaporating the solvent in the same condition:

(Relative evaporation rate)=(time for evaporating n-butyl acetate)/(time for evaporating the solvent) (1)

In the case of using only the solvent having a large relative evaporation rate of 1.7 or more, the surface of the coating film is dried and hardened by a high temperature air streams at the initial stage of the drying and thus the solvent inside the coating film is difficult to be dried. Then, when a solvent having a low evaporation rate as the relative evaporation rate being less than 1.7 is contained by 30% by weight or more in the solvent medium, the solvent medium in the inside of the coating film can be diffused and evaporated efficiently without hardening the surface of the coating film. When such a solvent is used, the surface of the coating film can be prevented from being rapidly dried compared with the inside of the coating film thereby capable of preventing formation of a hardened film on the surface of the coating film even if the water film is placed in an atmospheric at a temperature higher than a normal temperature (25° C.) during the drying step, or during a coating step and during transfer from the coating step to the drying step. Accordingly, the solvent in the inside can be dried efficiently before the surface of the coating film is dried and hardened.

A more preferred content of the solvent having a relative evaporation rate of less than 1.7 can be optionally selected depending on the time of the drying step, and the kind of the solvent. It is preferred that the content of the solvent having a relative evaporation rate of less than 1.7 is increased more since the formation of a hardened film of the surface of the coating film can be prevented. However, in a case of using only the solvent which is extremely hard to be evaporated such as diethylene glycol monobutyl ether as the solvent having a relative evaporation rate of less than 1.7, the evaporation rate may possibly be lowered excessively. In a case of using a solvent having such an extremely low evaporation rate, it is preferred to mix a solvent having a high relative evaporation rate to some extent for conducting drying in a short period of time. Table 1 shows relative evaporation rates of typical solvents.

TABLE 1

| Solvent | Relative evaporation rate | Boiling point (° C.) |
|---|---|---|
| Diethylene glycol monobutyl ether | 0.004 | 231 |
| Diethylene glycol monomethyl ether | 0.02 | 194 |
| Isophorone | 0.026 | 215.2 |
| Ethylene glycol monobutyl ether | 0.08 | 172 |
| Methyl cyclohexanone | 0.2 | 171.3 |
| Diisobutyl ketone | 0.2 | 168.2 |
| Cyclohexanone | 0.32 | 156 |
| Water | 0.38 | 100 |
| n-butanol | 0.47 | 117.3 |
| Ethylene glycol monomethyl ether | 0.53 | 125 |
| Xylene | 0.76 | 139 |
| n-butyl acetate | 1.00 | 126.3 |
| 1,3-dichloropropane | 1.06 | 121 |
| Isopropanol | 1.5 | 82.4 |
| Methyl isobutyl ketone | 1.6 | 116.7 |
| 1,4-dioxane | 1.65 | 101.4 |
| Methanol | 1.9 | 64.7 |
| Toluene | 2.0 | 110.6 |
| Isopropyl acetate | 3.5 | 89.4 |
| Methyl ethyl ketone | 3.7 | 79.5 |
| Benzene | 4.12 | 80.1 |
| Ethyl acetate | 4.2 | 76.8 |
| 1,3-dioxolan | 4.4 | 75 |
| Trichloroethane | 4.7 | 73.9 |
| Tetrahydrofuran | 4.85 | 66 |
| Acetone | 5.6 | 56.3 |
| Methylene dichloride | 6.35 | 40.2 |

FIG. 1 is a side elevational view schematically showing the constitution of a drying apparatus 1 used for the method of forming a photoreceptor in the invention. The drying apparatus 1 includes far infrared ray heating means 2 for irradiating far infrared rays to a coating film coated on a conductive substrate 5, electromagnetic induction heating means 3 for heating the conductive substrate 5 by induction heating, a blowing nozzle 4 for supplying a hot blow and rotating means 6 for rotating a cylindrical conductive substrate 5 to be formed with a coating film to be dried.

The far infrared ray heating means 2 is heating means having a power source (not shown) for irradiating far infrared rays to the coating film coated on the conductive substrate 5 and heating the coating film. As the far infrared ray heating means 2, a ceramic heater, sheath heater, halogeno lamp heater, quartz tube heater, etc. can be used. Among them, the ceramic heater having a long life and capable of easily changing the shape of the heater is particularly preferred. The far infrared ray heating means 2 is disposed for a length longer than the axial direction of the cylindrical conductive substrate 5 in order to uniformly heat the coating film coated on the conductive substrate 5. A reflection plate (not shown) is provided to the far infrared ray heating means 2 on the side opposite to that facing the conductive substrate 5. The reflection plate can prevent emission of the heat of the heated coating film to the outside and improve the energy efficiency. As the far infrared rays irradiated to the coating film, those at a wavelength of 4 to 1000 μm can be used. Further, in a case where the solvent medium in the coating solution comprises an organic compound, it is preferred that the far infrared rays have a maximum energy in a region of a wavelength at 4 to 25 μm where the absorption to the solvent medium is high.

As the electromagnetic induction heating means 3, plate type induction coils, etc. can be used. In the electromagnetic induction heating means 3 an electric current is supplied from a power source (not shown) to the coils to generate magnetic fields by the current. An eddy current flows in the conductive substrate 5 so as to offset the magnetic fields generated by the coils. The electromagnetic induction heating means 3 thus supplies the current to the conductive substrate 5 and generates heat in the conductive substrate 5 by utilizing the heat generated by the loss of the eddy current. A reflection plate (not shown) is provided to the electromagnetic induction heating means 3 on the side opposite to that facing the conductive substrate 5. This reflection plate can prevent emission of the heat of the heated coating film and improve the energy efficiency like the reflection plate provided to the far infrared ray heating means 2 on the side opposite to that facing the conductive substrate 5. Heating to the conductive substrate 5 is determined depending on the heating output and the frequency given by the electromagnetic induction heating means 3, the material and the thickness of the conductive substrate 5, etc. For example, in a case of using an aluminum cylindrical conductive substrate with a thickness of about 1 mm as the conductive substrate 5, the radio frequency given to the electromagnetic induction heating means 3 is preferably from 6.5 to 250 MHz in order to heat the conductive substrate 6 most efficiently.

In the drying apparatus 1 used for the method of forming the photoreceptor in the invention, heating is conducted by the far infrared ray heating means 2 and the electromagnetic induction heating means 3. The far infrared ray heating means 2 heats the solvent medium inside the coating film and the electromagnetic induction heating means 3 heats the conductive substrate 5 and heats the coating film by transmitting the generated heat to the coating film. Since the coating film can be dried also from the inside by using such heating means, drying in a short time is enabled and formation of the hardened film on the surface of the coating film can be prevented.

The blowing nozzle 4 provided in the drying apparatus 1 supplies an air stream at 50° C. or higher and 130° C. or lower to the coating film coated on the conductive substrate 5. As the blowing nozzle 4, a blower, air shower, etc. are used. The blowing nozzle 4 is provided with a HEPA filter (not shown) for supplying a clean air stream by filtration of an air stream to the conductive substrate 5. The HEPA filter removes obstacles such as dirts and dusts in the air stream supplied from the blowing nozzle 4 to the conductive substrate 5, prevents them from depositing on the coating film and prevents image defects formed upon use as the photoreceptor. The blowing speed of the air stream supplied from the blowing nozzle 4 is, preferably, 1 m/min or higher and 100 m/min or lower and, preferably, 5 m/min or higher and 50 m/min or lower. In a case where the blowing speed is lower than 1 m/min, the amount of air stream supplied to the conductive substrate 5 is insufficient making it difficult for temperature control and discharge of the evaporated solvent medium in the coating film. In a case where the blowing speed exceeds 100 m/min, the shape of the not-yet dried coating film is deformed by the force of the air stream thereby causing unevenness also in the coating film after drying. Further, the blowing amount of the air stream supplied from the blowing nozzle 4 is preferably 0.1 $m^3$/min or more and 10 $m^3$/min or less in order for temperature control and discharge of the evaporated solvent medium in the coating film. In a case where the blowing amount is less than 0.1 $m^3$/min, the amount of the air stream supplied to the conductive substrate 5 is insufficient to possibly make it difficult for temperature control and discharge of the evaporated solvent medium in the coating film. In a case where the blowing amount exceeds 10 $m^3$/min, increase of the temperature of the coating film may possibly be suppressed by the cooling effect of the air stream.

Since the drying step is conducted in an air stream at a higher temperature than the normal temperature as 50° C. or higher and 130° C. or lower for the temperature of the air stream in a case of using the drying apparatus 1 having such a blowing nozzle 4, increase of temperature of the coating film can be accelerated in the initial stage of drying and drying can be conducted in a short time.

When the solvent medium is evaporated in the drying step for the photoreceptor, while steams of the solvent medium are released from the coating film to the outside, when the atmosphere near the surface of the coating film reaches a saturated amount of steams, it not only stops evaporation of the solvent medium from the coating film but also results in a problem of causing re-liquefication. Since this partially dissolves the surface of the coating film, unevenness is caused and, in addition, since the steams have to be diffused only by means of convection, it takes a long time for drying.

In the method of forming the photoreceptor according to the invention, the coating film on the conductive substrate 5 is heated by the far infrared ray heating means 2 and the electromagnetic induction heating means 3 while supplying an air stream from the blowing nozzle 4 to the coating film on the conductive substrate 5. In a case where drying is conducted in such an air stream, since solvent medium steams can be effectively released from the coating film to the outside, drying can be conducted efficiently with no occurrence of surface unevenness.

Further, in the heating method according to the invention, since the coating film itself or the conductive substrate is heated directly without heating the atmosphere at the periphery of the coating film, the heat efficiency is extremely good. On the contrary, however, since temperature of the coating film increases abruptly, temperature control is difficult. Then, in a case where an air stream at a temperature lower than the predetermined drying temperature for the coating film is present, since the increase of temperature of the coating film is moderated at a temperature higher than the air stream temperature, the temperature of the coating film can be controlled easily. Accordingly, by properly setting the temperature of the air stream to 50° C. or higher and 130° C. or lower, it is possible to prevent that the temperature of the coating film increases exceeding the heat resistant temperature of the photoreceptor, particularly, exceeding the heat resistant temperature of a charge generating substance of a relatively low heat resistant temperature and exceeding the boiling point of the solvent medium thereby capable of preventing degradation of the electrical characteristics of an electrophotographic photoreceptor and occurrence of bubbles at the surface and in the inside of the coating film.

In a case where the temperature of the air stream is lower than 50° C., increase of the temperature of the coating film is retarded making it difficult for drying in a short time. In a case where the heating output is increased for drying the coating film in a short time in such an air stream, since the far infrared ray heating means 2 and the electromagnetic induction heating means 3 are means for heating from the inside of the coating film, the internal temperature may sometimes increases excessively although the temperature is appropriate at the surface of the coating film. When heating is conducted exceeding the boiling point of the solvent medium in the coating film, a great amount of bubbles are formed to cause unevenness in the coating film. In a case where heating is conducted at a temperature higher than the heat resistant temperature of the photoreceptor, the property, particularly, of the charge generating substance is deteriorated to lower the electrical characteristics as the photoreceptor.

In a case where the temperature of the air stream exceeds 130° C., this results in a state like the hot blow drying and since the surface of the coating film is dried and hardened before evaporation of the solvent medium inside the coating film, the solvent medium may possibly remain inside the coating film. Further, when the coating film is heated in the air stream, the temperature of the coating film increases excessively to result in the same problem as in a case where the temperature inside the coating film increases excessively.

The rotating means 6 provided in the drying apparatus 1 holds the cylindrical conductive substrate 5 such that the axial line thereof is horizontal and rotates the conductive substrate 5 about the axial line by a motor (not shown). The distance between the conductive substrate 5 and the far infrared ray heating means 2 and the distance between the conductive substrate 5 and the electromagnetic induction heating means 3 are properly determined depending on the kind of the constituent materials of the coating film (particularly solvent in the solvent medium) and the heating output from the heating means.

When the cylindrical conductive substrate 5 formed with the coating film is introduced into the drying apparatus 1, the viscosity of the coating film lowers to increase the fluidity as the temperature of the coating film increases. When the fluidity of the coating film increases, the coating film sags in the gravitational direction along the conductive substrate 5 and the film thickness is made not uniform in the circumferential direction of the conductive substrate 5. In the drying apparatus 1 used in the forming method of the invention, the effect of the gravitational force to the coating film can be made uniform and drying can be conducted while making the thickness in the circumferential direction uniform by rotating the cylindrical conductive substrate 5 about the axial line while holding it such that the axial direction is in parallel with the horizontal direction. Further, in the drying apparatus 1, those portions of the conductive substrate 5 not undergoing far infrared irradiation from the far infrared ray heating means 2 are not heated. However, by rotating the conductive substrate 5 by the rotational means 6, unevenness in the heating for the entire conductive substrate 5 can be prevented and the entire portion can be heated uniformly. The number of rotation of the conductive substrate 5 by the rotational means 6 is preferably from 1 to 500 rpm and, more preferably, from 5 to 200 rpm. In a case where it is less than one turn per min, the effect by rotation can not be obtained, which causes sagging of the coating film to result in unevenness in the thickness of the coating film. In a case where it exceeds 500 rpm, the coating film is scattered by the centrifugal force.

Further, the drying apparatus 1 includes a thermometer (not shown) for measuring the temperature of the coating film, and control means (not shown) for controlling the far infrared ray heating means 2, the electromagnetic induction heating means 3 and the blowing nozzle 4 in accordance with the temperature measured by the thermometer. As the thermometer, a non-contact type radiation thermometer or the like can be used. The control means can be attained by central processing units (simply referred to as CPU), chips, integrated circuits, etc. The control means adjusts the heating output from the far infrared ray heating means 2 and the electromagnetic induction heating means 3 to control the temperature of the air stream supplied from the blowing nozzle 4 to the coating film.

In the drying step, the temperature is once increased to a temperature suitable to the drying of the coating film (temperature as high as possible within a range lower than the heat resistant temperature of the photoreceptor and lower than the boiling point of the solvent medium), and the solvent medium is evaporated while keeping the temperature. In the initial stage of the drying step, heat from the far infrared ray heating means 2 and the electromagnetic induction heating means 3 is consumed for the increase of the temperature of the coating film and the conductive substrate by the heat capacity of the coating film and the conductive substrate. The control means provided to the drying apparatus 1 increases the heating output from the far infrared ray heating means 2 and the electromagnetic induction heating means 3 in the initial stage of the drying step. This increases the temperature of the coating film and the conductive substrate in a short time. Further, the control means increases the temperature of the air stream supplied from the blowing nozzle 4 to the coating film, as well as increases the blowing amount thereof. This increases the temperature of the atmosphere for drying the coating film and shortens the time required for increasing the temperature of the coating film.

In this case, when the heating output at the initial stage is kept as it is, this always increases the temperature of the coating film to increase temperature of the coating film to higher than the heat resistant temperature of the photoreceptor, or increase temperature of the coating film exceeding the boiling point of the solvent medium in the coating film in the course of the drying step. When the coating film is heated to a temperature higher than the heat resistant temperature of the photoreceptor, it results in a problem, for example, that the effect of the charge generating substance with low heat resistant temperature is not provided to deteriorate the electrical characteristic of the photoreceptor. Further, in a case where the temperature of the coating film increases exceeding the boiling point of the solvent medium in the coating film, the solvent medium generates a great amount of bubbles, unevenness, etc. at the surface of the coating film. Accordingly, the control means provided in the drying apparatus 1 decreases the heating output from the far infrared ray heating means 2 and the electromagnetic inducting heating means 3 to less than that in the initial stage so that the temperature of the coating film does not exceed a preferred temperature at or just before the instance reaching the temperature.

Further, the control means lowers the temperature of the atmosphere by lowering the temperature of the air stream supplied from the blowing nozzle 4 to the coating film, or properly controlling the blowing amount of the air stream depending on the degree of the temperature of the air stream to prevent unnecessary increase of temperature of the coating film. In the course of the drying step, drying of the solvent medium in the coating film proceeds and the amount of the solvent remaining in the coating film is decreased to also decrease the heat of evaporation required for evaporation of the solvent medium. Accordingly, the control means further decreases the heating output also taking this into consideration and further lowers the temperature of the air stream supplied from the blowing nozzle 4 to the coating film. In a case where the temperature of the air stream is higher than the temperature of the coating film, it is possible to promote the increase of temperature of the coating film as the blowing amount of the air stream is increased and the rise of temperature can be conducted moderately when the blowing amount is decreased. In a case where the temperature of the air stream is lower than the temperature of the coating film, it is possible to lower the temperature of the coating film by increasing the blowing amount of the air stream, and moderate the lowering of temperature by decreasing the blowing amount. As described above, it is necessary that the blowing amount of the air stream is controlled while considering the temperature of the air stream and the temperature of the coating film.

Since the drying apparatus 1 has such control means, in the initial stage of the drying step till the coating film reaches the preferred temperature described above, the heating output from the far infrared ray heating means 2 and the electromagnetic induction heating means 3 is increased. Further, in the intermediate state in the drying step, that is, the stage where the temperature of the coating film reaches the preferred temperature described above or in the stage just before reaching the preferred temperature, the heating output from the far infrared ray heating means 2 and the electromagnetic induction heating means 3 can be controlled to less than that in the initial stage.

In the same manner, it can be controlled such that the temperature of the air stream supplied from the blowing nozzle 4 to the coating film is increased in the initial stage of the drying step, and the temperature of the air stream supplied from the blowing nozzle 4 to the coating film is lowered in the intermediate stage of the drying step.

As described above, the temperature of the coating film can be controlled strictly by changing the heating output of the heating means and the temperature and the blowing amount of the air stream in the drying step, and it is possible to provide a photoreceptor having a photosensitive layer comprising a coating film having good smoothness and free of unevenness, flaking and cracking in an extremely short time.

While control by the control means is applied preferably to all of the far infrared ray heating means 2, electromagnetic induction heating means 3, and the blowing nozzle 4, it may suffice that the control is applied to one or more means selected from the far infrared ray heating means 2, the electromagnetic induction heating means 3, and the blowing nozzle 4. For example, only the heating output from the far infrared ray heating means 2 and the electromagnetic induction heating means 3 may be controlled while setting the temperature and the blowing amount of the air stream supplied from the blowing nozzle 4 constant. Further, the temperature and the blowing amount of the air stream supplied from the blowing nozzle 4 may be controlled while setting the heating output of the infrared ray heating means 2 and the electromagnetic induction heating means 3 constant.

While electromagnetic induction heating means 3 in the drying apparatus 1 is plate type induction type coils in this embodiment, it may be adopted a constitution provided inside the hollow cylindrical conductive substrate 5 or a constitution provided so as to cover the periphery of the cylindrical conductive substrate 5 in order to uniformly apply heating to the conductive substrate 5.

The heating means of the drying apparatus 1 is not restricted only to the constitution of using the far infrared ray heating means 2 and the electromagnetic induction heating means 3 but may also be means capable of attaining the heating method by the microwave heating method or the dielectric heating method.

The heating principle is identical for the microwave heating method and the dielectric heating method. Heating by the heating method described above is conducted based on the principle of violently moving dipoles in the molecules of a dielectric material in accordance with the reversion of electric fields by the application of high frequency voltage and generating heat by the frictional heat caused by the movement. The frequency of the electromagnetic waves used is different between the microwave heating method and the dielectric heating method. In the microwave heating, electromagnetic waves in the UHF (ultrahigh frequency) band (300 MHz to 3 GHz) are used and in the dielectric heating, electromagnetic waves from 1 to 200 MHz are used. The microwave heating and the dielectric heating are conducted in a furnace designed such that electromagnetic waves can be irradiated with no unevenness to samples.

In view of the heating principle, the microwave heating and the induction heating may possibly cause sparks from edge portions of a metal or a conductor not grounded to the earth. Accordingly, in a case of drying the organic solvent medium, it is necessary to rapidly discharge the evaporated solvent by a sufficient amount of an air stream. Further, since the materials to be heated are only those electric materials having dipoles and they are determined depending on the dielectric tan δ, the inherent value of the coating film constituent substance, it is necessary to select the material used as the solvent medium. Accordingly, this heating method is optimal for the drying of the coating film containing 50% or more of water with large tan δ in the solvent medium and this is suitable to the drying of an undercoat layer using sometimes aqueous coating solutions and a protective layer using a sol-gel method.

As described above, in a case of using the microwave heating means for heating by the microwave heating method and the dielectric heating means for heating by the dielectric heating method as the heating means, sparks are liable to occur from the conductive substrate in view of the characteristics thereof and the spark may sometimes lead to ignition and detonation. Further, it is considered difficult to prevent sparks. In the drying step included in the forming method of the invention, since the coating film is dried while supplying an air stream at a temperature of 50° C. or higher and 130° C. or lower to the coating film, the gas of the solvent medium can be discharged efficiently, as well as ignition or detonation of the evaporated and stagnated solvent medium can be prevented.

The reflection plate provided to the far infrared ray heating means 2 on the side opposite to that facing the conductive substrate 5 or provided to the electromagnetic induction heating means 3 on the side opposite to that facing the conductive substrate 5 may not necessarily be provided but provision of them can improve the energy efficiency.

The photoreceptor manufactured by the method according to the invention is not restricted only to that in which the shape of the conductive substrate is cylindrical but the shape thereof may also be a circular columnar shape, or sheet-like shape. In a case where the conductive substrate is in a sheet-like shape, it may be placed on a table (not shown) and the coating film can be heated and dried by the same method.

Figure 2:
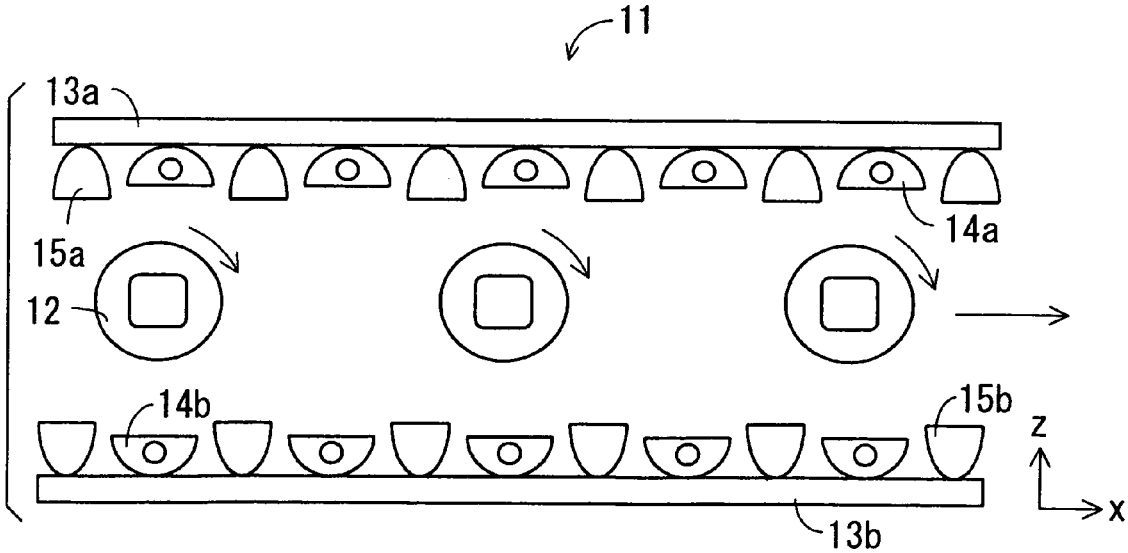
FIG. 2 is a side elevational view schematically showing the constitution of a drying apparatus used in the method of forming a photoreceptor of the invention.

FIG. 2 is a side elevational view schematically showing the constitution of a drying apparatus 11 used in the method of forming a photoreceptor of the invention. The drying apparatus 11 shown in FIG. 2 is a continuous type drying furnace which is optimal to a case of applying the drying step used in the forming method of the invention to the mass production of photoreceptors. In FIG. 2, a direction along which the conductive substrate 12 is conveyed is defined as an x direction, and a direction perpendicular to the direction along which the conductive substrate 12 is conveyed and to an axial direction of the conductive substrate 12 is defined as a z direction. The drying apparatus 11 includes a pair of base substrates 13*a* and 13*b*, a plurality of heating means 14*a* and a plurality of blowing nozzles 15*a* which are provided on the base substrate 13*a*, a plurality of heating means 14*b* and a plurality of blowing nozzles 15*b* which are provided on the base substrate 13*b*, and moving means (not shown). The pair of base substrates 13*a* and 13*b* are spaced apart in the z direction with reference to the cylindrical conductive substrate 12 of which an axial line is kept horizontal. The moving means transport the conductive substrate 12 in the x direction between the pair of the base substrate 13*a* and 13*b* while rotating the substrate 12 in the axial direction. The heating means 14*a* and 14*b*, and the blowing nozzles 15*a* and 15*b* are described hereinafter with no indication of alphabetical letters, excluding the case of explaining them while directing to specified heating means or blowing nozzle.

The heating means 14 is one or more of heating means selected from the group consisting of far infrared ray heating means, microwave heating means, dielectric heating means, and induction heating means. Since the blowing nozzle 15 is identical with the blowing nozzle 4 provided in the drying apparatus 1 as described above, the description is to be omitted. The moving means conveys the cylindrical conductive substrate 12 in the x direction while keeping the axial direction thereof in parallel with the horizontal direction and rotating the conductive substrate 12 about the axial line between the pair of base substrates 13*a*, 13*b*.

In the drying apparatus 11 described above, the conductive substrate 12 moves at a predetermined speed under rotation between the heating means 14 and the blowing nozzle 15 disposed to the pair of base substrate 13*a*, 13*b* and the coating film formed to the conductive substrate 12 is dried. By the use of the drying apparatus 11 described above, since the coating film formed on the plurality of conductive substrates 12 can be dried in a short time, it is suitable to mass production.

It is preferred that the plurality of heating means 14 and the blowing nozzles 15 are disposed alternately in view of facilitating the temperature control for the coating film. Further, it is preferred to divide a portion from the entrance to the exit for the conductive substrate 12 into several units each comprising a plurality of heating means 14 and blowing nozzles 15 and set condition for the heating output of the heating means 14 and the air stream of the blowing nozzles 15 to the optimal conditions on every units. For example, in the unit from the inlet to a position where temperature of the coating film is at a suitable temperature, the heating output from the heating means 14 is increased and the temperature of the air stream from the blowing nozzle 15 is set higher to accelerate the temperature rising rate for the coating film intended for short time drying. On the other hand, in the unit from the position where temperature of the coating film reaches a preferred temperature to the vicinity of the exit, the heating output from the heating means 14 is decreased and the temperature of the air stream supplied from the blowing nozzle 15 is lowered so that the temperature of the coating film does not increase excessively. This can complete drying in a short time and facilitate the control of the heating means 14 and the blowing nozzle 15 in the drying step.

The drying method for the coating film described above is not restricted only to the method of drying the coating film of the photosensitive layer formed on the conductive substrate of the electrophotographic photoreceptor, but it can be used also for the method of drying the coating film formed by coating a coating solution containing ingredients for the coating film and the solvent medium. In a case of conducting heating by the induction heating method, it is necessary to use a conductive substrate.

EXAMPLE

Examples of the invention are to be described below.

Example 1

10 parts by weight of a charge transporting substance represented by the following structural formula (2) as a charge transporting material, 0.1 part by weight of a triphenylamine dimer (simply referred to as TPD: internal standard substance) represented by the following structural formula (3), and 18 parts by weight of a polycarbonate resin as a binder resin (trade name of products: YUPIRON Z400, manufactured by Mitsubishi Engineering Plastics Co.) were dissolved in 112 parts by weight of cyclohexanone, to prepare a coating solution for forming a charge transporting layer. The coating solution for forming the charge transporting layer was coated by a roll coating method to a thickness of 20 μm on an aluminum substrate of 0.5 mm thickness to obtain a coated film sample. The thus obtained coated film sample was instantly placed 10 cm just below a ceramic heater at a heater temperature of 240° C. (trade name of products: Y-1 model, manufactured by Yamaki Denki Co.), and an air stream at a temperature of 80° C., at a blowing speed of 10 m/min, and with a blowing amount of 0.5 $m^3$/min was supplied uniformly to the coated film sample, to dry the coated film sample for 15 min.

(2)

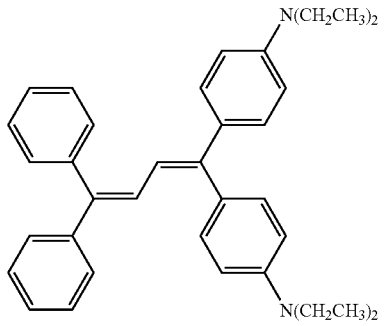

(3)

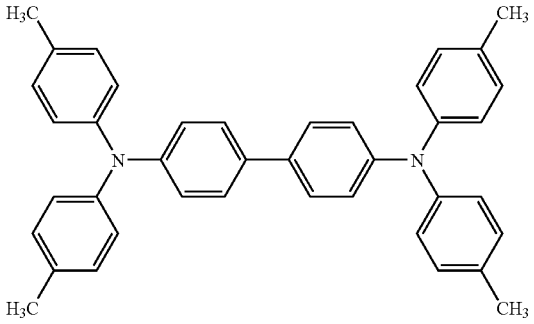

Example 2

A coating film sample was dried in the same manner as in Example 1 except for changing the ceramic heater to a microwave heating device at 2450 MHz (experimental equipment, manufactured by Fuji Denpa Koki Co.), setting the coating film sample in the experiment apparatus and heating the same at an effective power of 1.2 kW.

Example 3

A coating film sample was dried in the same manner as in Example 1 except for changing the ceramic heater to a radio frequency induction heating device (trade name of product: MU-1700B, with flat type heating coil, manufactured by Sekisui Medical Electronic Co.), setting the coating film sample above the coils and heating the same at an oscillation frequency of 320 KHz and at a power of 100 W.

Example 4

A coating film sample was manufactured and dried in the same manner as in Example 1 except for changing the solvent medium of the coating solution for forming the charge transporting layer to 72 parts by weight of toluene and 40 parts by weight of cyclohexanone (cyclohexanone content in the solvent medium: 36% by weight).

Comparative Example 1

A coating film sample was dried in the same manner as in Example 1 except for changing the ceramic heater to a hot blow drier at 130° C. (trade name of product: WFO-1001SD, manufactured by Tokyo Rika Kikai Co.).

Comparative Example 2

A coating film sample was dried in the same manner as in Example 1 except for heating without supplying an air stream.

Comparative Example 3

While a coating film sample was started to dry in the same manner as in Example 2 except for heating without supplying on air stream, since it was confirmed that sparks were generated at the portion of the substrate to result in a possibility of ignition and detonation to the evaporated and stagnated solvent medium, drying of the coating sample was interrupted.

Comparative Example 4

A coating film sample was dried in the same manner as in Example 3 except for heating without supplying the air stream.

Comparative Example 5

A coating film sample was manufactured and dried in the same manner as in Example 1 except for changing the solvent medium of the coating solution for forming the charge transporting layer to 112 parts by weight of toluene.

Comparative Example 6

A coating film sample was manufactured and dried in the same manner as in Example 1 except for changing the solvent medium of the coating solution for forming the charge transporting layer to 84 parts by weight of toluene and 28 parts by weight of cyclohexanone (cyclohexanone content in the solvent medium: 25% by weight).

[Evaluation 1]

A portion of a coated sample of each of Examples 1 to 4 and Comparative Examples 1 to 6 was cut out, extracted with acetone and the extraction solution was quantitatively analyzed for the residual amount of solvent medium using TPD as an internal standard substance by a high speed liquid chromatographic apparatus (trade name of product: Agilent 1100 series, manufactured by Yokokawa Analytical Systems Co.). The residual amount of solvent is represented by the ratio of the weight of the residual solvent based on the weight of the solid contents in the coating film. Table 2 shows the condition for the drying step and the state of coating film obtained by the drying step for examples and comparative examples.

TABLE 2

| | Heating method | Air stream | Cyclohexanone content (wt %) | Drying time (min) | State of coating film | Residual amount of solvent (wt %) | Remarks |
|---|---|---|---|---|---|---|---|
| Example 1 | Far infrared ray | Used | 100 | 15 | Good | 0.04 | |
| Example 2 | Microwave | Used | 100 | 15 | Good | 0.13 | |
| Example 3 | Induction heating | Used | 100 | 15 | Good | 0 | |
| Example 4 | Far infrared ray | Used | 36 | 15 | Good | 0.01 | |
| Comp. Example 1 | Hot blow | — | 100 | 15 | Good | 12.4 | |
| Comp. Example 2 | Far infrared ray | None | 100 | 15 | Surface unevenness | 7.8 | |
| Comp. Example 3 | Microwave | None | 100 | — | — | — | Spark generated, drying interrupted |
| Comp. Example 4 | Induction heating | None | 100 | 15 | Surface unevenness | 3.2 | Solvent coagulates at periphery of coating film surface |
| Comp. Example 5 | Far infrared ray | Used | 0 | 15 | Crack - bubbles present | 3.9 | |
| Comp. Example 6 | Far infrared ray | Used | 25 | 15 | Bubbles present | 5.7 | |

In Comparative Example 1 conducting drying by hot blow drying, the residual solvent remained by 10% or more also after drying. Further, in the drying by the hot blow, since heating unevenness was caused to the surface of the coating film, unevenness resulted also in the surface state of the coating film after the drying. Since the drying step according to the method of forming the coating film of the invention shown in Examples 1 to 3 adopted a method of directly heating the coating film or the substrate such as the far infrared ray heating, microwave heating or induction heating, the coating film sample could be dried in a short time of about 15 min even when the solvent used as the solvent medium for the coating film sample was cyclohexanone having a small relative evaporation rate as less than 1.7. Further, the surface of the obtained coating film was also flat and favorable.

In view of the result of Comparative Examples 2 and 4, in a case where the air stream is not supplied even when the drying was conducted by the heating method such as the far infrared ray heating or induction heating, the solvent medium evaporated in the inside of the coating film stagnated near the surface of the coating film, which was liquefied again by the temperature difference relative to the atmosphere to require a long time for drying. Also for the coating film after drying, a considerable amount of the solvent medium remained in the coating film. Further, when drying was conducted by the microwave heating in a state with no air stream as in Comparative Example 3, since spark was generated from the aluminum substrate to result in a possibility of causing ignition and detonation to the stagnated solvent medium gas, the drying had to be interrupted the drying in the midway.

Further, when cyclohexanone having a low relative evaporation rate was contained by 30% by weight or more in the solvent medium as in Example 4, the coating film sample could be dried substantially for about 15 min. On the other hand, in a case of using only toluene having high relative evaporation rate of 1.7 or more or in a case of containing cyclohexanone having a relative evaporation rate of less than 1.7 only by less than 30% by weight as in Comparative Example 6, since the surface of the coating film was dried and hardened to form a hardened film before the completion for the drying of the inside of the coating film and the solvent medium in the inside became less evaporated, more residual amount of the solvent medium was detected. Further, since the temperature of the coating film was increased in a short time, generation of a great amount of bubbles was also confirmed.

Example 5

Drying was conducted in the same manner as in Example 1 except for using an aluminum substrate appended with a sheet-type thermocouple on the substrate (trade name of product: C060-T, manufactured by Chino Co.), and change with time of the temperature for the coating film was measured.

Example 6

A coating film sample was dried in the same manner as in Example 5 except for drying at a heater temperature of 260° C., at an air stream temperature of 110° C., at a blowing speed of 20 m/min, and with a blowing amount of 1.0 $m^3$/min for the initial one min, at a heater temperature of 220° C., at an air stream temperature of 80° C., at a blowing speed of 10 m/min, and with a blowing amount of 0.5 $m^3$/min after lapse of 1 min to 5 min, and at a heater temperature of 210° C., at an air stream temperature of 70° C., at a blowing speed of 10 m/min, and with a blowing amount of 0.5 $m^3$/min for 5 min after lapse of 15 min and change with time of the temperature for the coating film was measured.

Comparative Example 7

A coating film sample was dried and the aging change of temperature of the coating film was measured in the same manner as in Example 5 except for changing the heater temperature to 260° C. and the stream temperature to 40° C.

Comparative Example 8

A coating film sample was dried in the same manner as in Example 5 except for changing the heater temperature to 200° C. and the air stream temperature to 135° C., and aging change with time of temperature of the coating film was measured.

[Evaluation 2]

In Examples 5, 6 and Comparative Examples 7, 8, the aging change of temperature of the coating film was measured by a sheet-type thermocouple and the residual amount of the solvent medium was quantitatively analyzed by the same method as for the Evaluation 1, 5 min (300 sec), 10 min (600 sec) and 15 min (900 sec) after the starting the drying.

Figure 3:
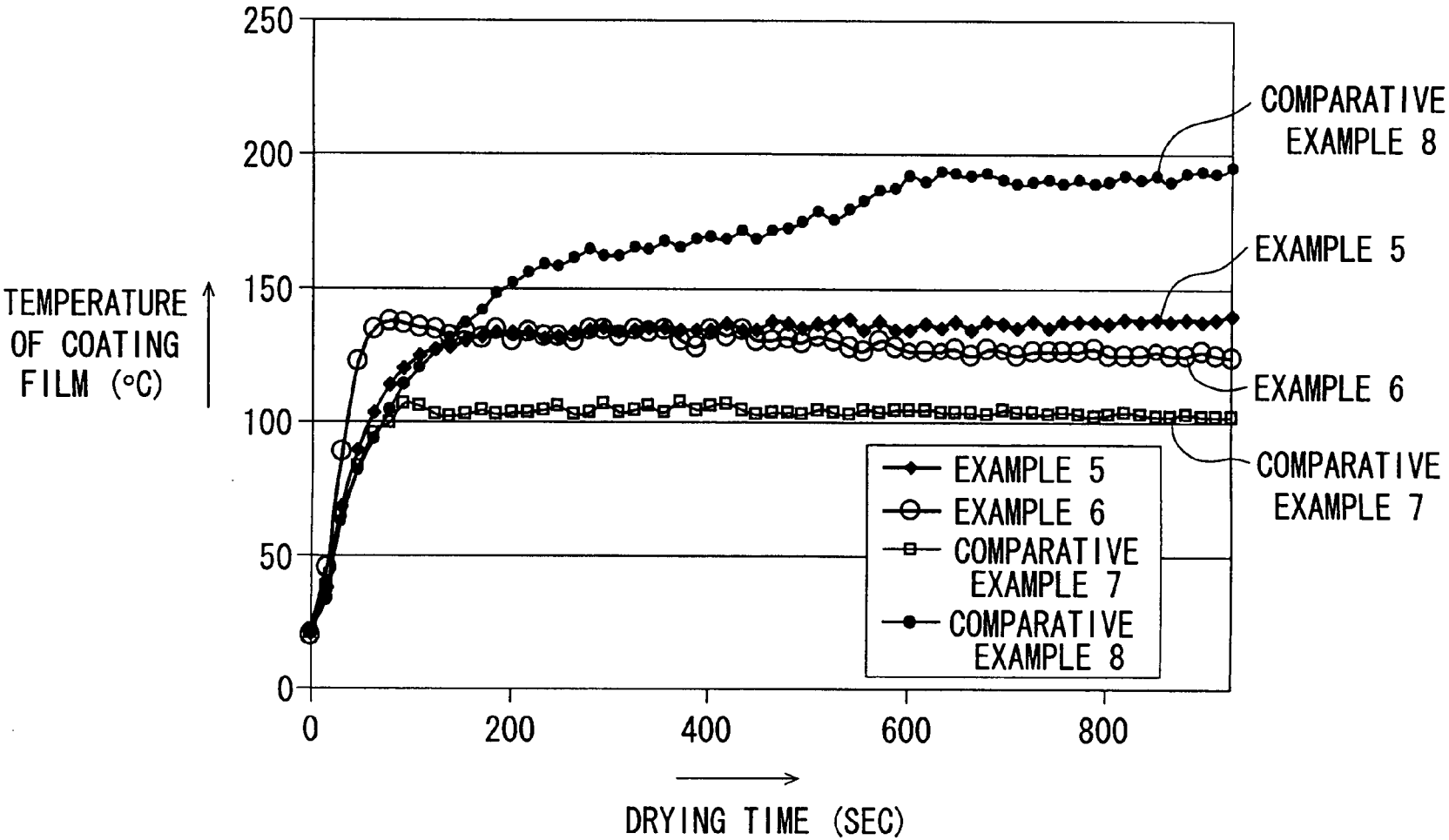
FIG. 3 is a graph showing the result of measuring the change with time of temperature of the coating film in the drying step of Examples 5 and 6 and Comparative Examples 7 and 8.

FIG. 3 is a graph showing the result of measuring the change with time of temperature of the coating film in the drying step of Examples 5, 6 and Comparative Examples 7, 8. Further, Table 3 shows the result of quantitatively analyzing the residual amount of solvent medium in the coating film by the same method as in Evaluation 1, 5 min, 10 min, and 15 min after starting the drying.

TABLE 3

| | Residual amount of solvent medium (wt %) | | |
|---|---|---|---|
| Drying time (min) | 5 | 10 | 15 |
| Example 5 | 5.8 | 0.35 | 0.06 |
| Example 6 | 1.8 | 0.09 | 0.01 |
| Comp. Example 7 | 15.3 | 5.8 | 2.50 |
| Comp. Example 8 | 7.8 | 3.5 | 1.2 |

In the drying step, in a case of controlling the heating output and the temperature and the blowing amount of the air stream (Example 6), the coating film can be dried more efficiently than in the case of drying under the constant condition for the heating output and the temperature and the blowing amount of the air stream (Example 5). By controlling the heating output and the temperature and the blowing amount of the air stream as described above, the residual amount of the solvent medium was reduced to 0.1% by weight or less and the drying could be completed substantially for about 10 min. This is considered that the drying at the surface of the coating film could be prevented and the solvent medium contained inside the coating medium could be removed before formation of the hardened film by increasing the heating output, setting the temperature of the air stream higher and increasing the blowing amount of the air stream at high temperature in the initial stage of the drying step.

Further, from the result of Comparative Example 7, in a case where the temperature of the air stream was as low as 40° C., since temperature of the coating film could not be increased sufficiently even when the temperature of the heater was set higher, the coating film could not be dried sufficiently to increase the amount of the residual solvent in the coating film. On the other hand, in view of the result of Comparative Example 8, in a case where the air stream temperature was as high as 135° C., while temperature of the coating film was increased sufficiently even when the temperature of the heater was set lower, not only the surface of the coating film was dried and the solvent remained in the initial stage but also temperature of the coating film increases excessively and bubbles were resulted in the coating film by heating exceeding the boiling point of cyclohexanone (156° C.) as the solvent medium and, further, it exceeded the heat resistant temperature of the charge transporting substance (about 150° C.) as in the case of the hot blow drying furnace.

Example 7

A cylindrical aluminum conductive substrate of 40 mm diameter and 340 mm length was prepared and each of the layers was coated and formed as described below.

a: Undercoat Layer 21 parts by weight of titanium oxide (trade name of products: TT55A, manufactured by Ishihara Industry Co.), and 39 parts by weight of a copolymerized nylon resin (trade name of product: Amilan CM8000, manufactured by Toray Co.) were added to a mixed solvent of 329 parts by weight of methanol and 611 parts by weight of 1,3-dioxolan, and dispersed by using a paint shaker to prepare a coating solution for forming an undercoat layer. The coating solution for forming the undercoat layer was filled in a coating tank and an undercoat layer of 1.0 μm thickness was formed by a dip coating method of dipping and then pulling up the conductive substrate into and out of the coating tank, and left at a room temperature for one hour and then the charge generating layer was coated.

b: Charge Generating Layer 2 parts by weight of oxotitanium phthalocyanine having a crystal structure showing a distinct diffraction peak at least at a Bragg angle 2θ (error: ±0.2°) of 27.2° in X-ray diffraction spectrum by Cu—Kα characteristic X-rays (wavelength: 1.54 Å) as a charge generating material, 1 part by weight of a polyvinyl butyral resin (trade name of products: S-LEC BM-S, manufactured by Sekisui Chemical Industry Co.) and 97 parts by weight of methyl ethyl ketone were mixed and put to a dispersion treatment by a paint shaker to prepare a coating solution for forming a charge generating layer. The coating solution for forming the charge generating layer was coated on the undercoat layer by the same dip coating method as that for the undercoat layer to form a charge generating layer of 0.4 μm thickness over the undercoat layer. After leaving at a room temperature for one hour, the next charge transporting layer was coated. Bragg angle 2θ means herein an angle formed between an incident X-ray and a diffraction X-ray and represents a so-called diffraction angle.

c: Charge Transporting Layer 10 parts by weight of a charge transporting substance represented by the structural formula (2) as the charge transporting substance, 0.1 part by weight of a triphenylamine dimer represented by the structural formula (3) (simply referred to as: TPD), 18 parts by weight of a polycarbonate resin (trade name of products: YUPIRON Z300, manufactured by Mitsubishi Engineering Plastics Corp.) as a binder resin, and 0.5 part by weight of 2,6-di-t-butyl-4-methylphenol (simply referred to as BHT) were dissolved in 130 parts by weight of cyclohexanone to prepare a coating solution for forming a first charge transporting layer. The obtained coating solution for forming the first charge transporting layer was coated on the charge generating layer by a roll coating method to form a coating film and drying step was conducted as described below.

After coating the coating solution for forming the charge transporting layer, it was instantly set to a drying apparatus, the axial direction of the cylindrical conductive substrate was kept in parallel with the horizontal direction and the conductive substrate was rotated at 50 rpm. For the initial 3 min in the drying step, it was situated just 10 cm below a ceramic heater (trade name of product: Y-1 model, manufactured by Yamaki Denki Co.) at a heater temperature of 260° C., an air stream at a temperature of 100° C., at a blowing speed of 20 m/min, and with a blowing amount of 1.0 $m^3$/min was supplied uniformly to the coating film. Then the coating film was dried for 15 min in total including the initial three min at a heater temperature of 220° C., at an air stream temperature of 80° C., at a blowing speed of 10 m/min, and with a blowing amount of 0.5 $m^3$/min, to manufacture an electrophotographic photoreceptor of Example 7.

Example 8

An electrophotographic receptor of Example 8 was manufactured in the same manner as in Example 7 excepting for changing the ceramic heater to a microwave heater irradiating electromagnetic waves at 2450 MHz (Experimental equipment, manufactured by Fuji Denpa Koki Co.) and heating at an effective power of 1.2 kW.

Example 9

An electrophotographic photoreceptor of Example 9 was manufactured in the same manner as in Example 7 except for changing the ceramic heater to a radio frequency induction heating device (trade name of product: MU-1700B with flat type heating coil, manufactured by Sekisui Medical Electronics Co.) and heating at an oscillation frequency of 320 kHz, and at an output of 100 W.

Comparative Example 9

An electrophotographic photoreceptor of Comparative Example 9 was manufactured in the same manner as in Example 7 except for not rotating the cylindrical conductive substrate in the drying step.

Comparative Example 10

An electrophotographic photoreceptor of Comparative Example 10 was manufactured in the same manner as in Example 7 except for conducting drying while keeping the axial direction of the cylindrical conductive substrate in parallel with the vertical direction, rotating the substrate about the axial direction in the drying step.

[Evaluation 3]

The distribution for the film thickness of the charge transporting layers in the circumferential direction of electrophotographic photoreceptors manufactured in Example 7 and Comparative Example 9 was measured by a multi-functional multi-channel spectrophotometer (trade name of product: MCPD 2000, manufactured by Otsuka Denshi Co.). Further, the distribution for the film thickness of the charge transporting layers in the axial direction of electrophotographic photoreceptors manufactured in Example 7 and Comparative Example 10 was measured by the multi-functional multi-channel spectrophotometer.

Figure 4:
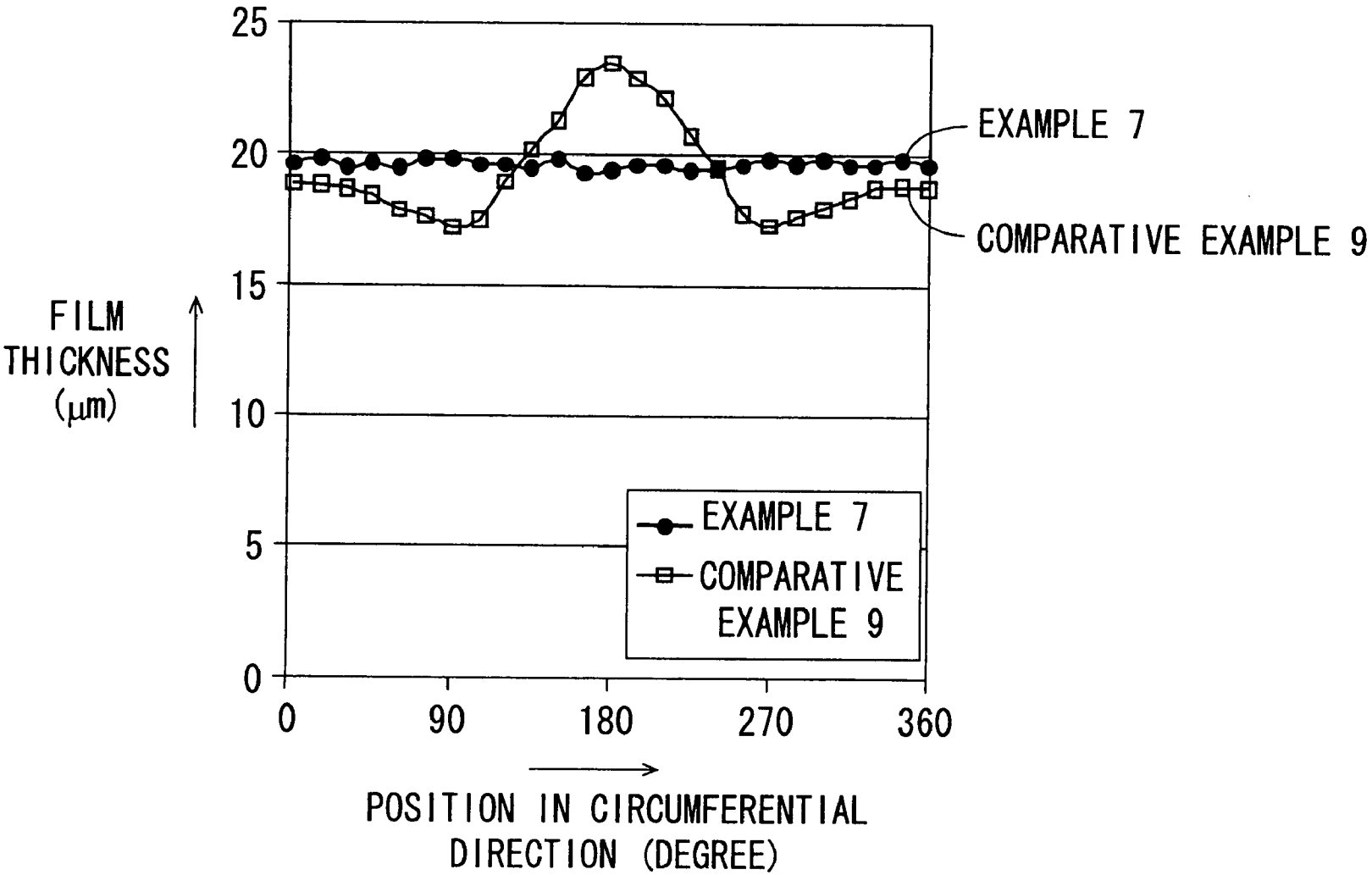
FIG. 4 is a view showing the distribution for the film thickness in the circumferential direction of electrophotographic photoreceptors manufactured in Example 7 and Comparative Example 9.
Figure 5:
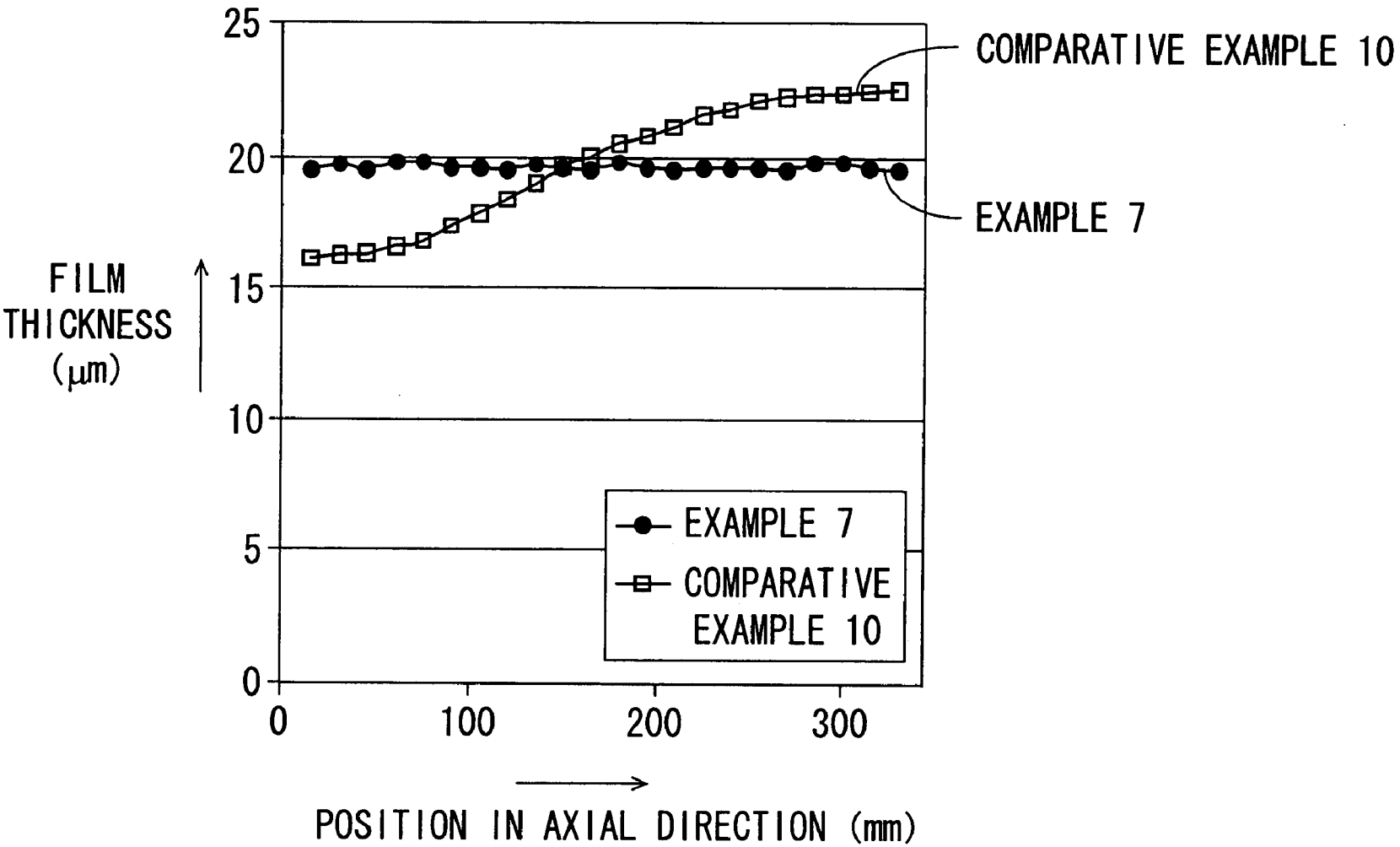
FIG. 5 is a view showing the distribution for the film thickness in the axial direction of electrophotographic photoreceptors manufactured in Example 7 and Comparative Example 10.

FIG. 4 is a view showing the distribution for the film thickness in the circumferential direction of electrophotographic photoreceptors manufactured in Example 7 and Comparative Example 9 and FIG. 5 is a view showing the distribution for the film thickness in the axial direction of electrophotographic photoreceptors manufactured in Example 7 and Comparative Example 10. In FIG. 5, the position of 0 for the position in the axial direction in FIG. 5 shows one end of the conductive substrate supported in parallel with the vertical direction on the side opposite to the gravitational direction. As in Example 7, in a case of conducting drying while keeping the axial direction of the cylindrical conductive substrate in parallel with the horizontal direction and rotating the substrate about the axial line, a good distribution for the film thickness could be obtained with the film thickness being substantially constant both in the circumferential direction and in the axial direction. On the other hand, in the photoreceptor in which the conductive substrate was not rotated about the axial line although the axial direction thereof was kept in parallel with the horizontal direction as in Comparative Example 9, a coating solution of lowered viscosity and with increased fluidity due to the increase of temperature sagged in the gravitational direction along the conductive substrate by the gravitational force making the film thickness in the circumferential direction not uniform. Further, as in Comparative Example 10, in a case of conducting the drying step while keeping the axial direction of the conductive substrate in parallel with the vertical direction although rotated about the axial line, the coating solution sagged in the gravitational direction making the film thickness not uniform in the axial direction.

[Evaluation 4]

For the electrophotographic photoreceptors manufactured in Examples 7 to 9, the residual amount of the solvent medium was analyzed quantitatively in the same manner as in Evaluation 1. Each of the photoreceptors was mounted to a laser printer (trade name of product: DM-4501, manufactured by Sharp Corp.), a surface potential meter (trade name of products: CATE 751, manufactured by Gentec Co.) was provided inside the body of the laser printer such that the surface potential of the electrophotographic photoreceptor in the image forming process could be measured, and the charged potential Vo (V) as the surface potential just after charging and the exposed potential VL (V) as the surface potential just after exposure by a laser light were measured under a high temperature/high humidity circumference at temperature 35° C./relative humidity 80% and under a low temperature/low humidity circumstance at 5° C./20%. Further, the measurement for the potential was conducted both in the initial stage before forming images and after fatigue by conducting image formation for 10,000 sheets. Charging to the surface of the electrophotographic photoreceptor was conducted by a negative charging process.

Further, half-tone images for evaluation image picture quality were formed and image defects and image quality were evaluated in the initial stage and after fatigue by conducting image formations for 10,000 sheets. The resultant half-tone images were observed visually and the image quality was evaluated depending on the extent of image defects such as blanking, black streaks and image blurring. The evaluation criterion for the image quality was as shown below.

A: good: no image defects exist.

B: somewhat poor: negligible image defects exist.

C: poor: distinct image defects exist.

Table 4 shows the charged potential Vo and the exposed potential VL measured under each of the conditions as described above, as well as evaluation for the formed images. In a case where the absolute value for the difference between the charged potential Vo (V) in the initial stage and the charged potential Vo (V) after fatigue is 50 V or lower under the high temperature/high humidity circumstance and 50 V or less under the low temperature/low humidity circumstance, there is no problem for the repetitive stability in view of actual use. Further, in a case where the absolute value for the difference between the exposed potential VL (V) in the initial stage and the exposed potential VL (V) after fatigue is 30 V or lower under the high temperature/high humidity circumstance and 30 V or lower under the low temperature/low humidity circumstance, there is no problem for the repetitive stability in view of actual use.

In a case where the absolute value for the difference between the charged potential Vo (V) under the high temperature/high humidity circumstance and the charged potential Vo (V) under the low temperature/low humidity circumstance is 30 V or lower in the initial stage and 40 V or lower after fatigue, there is no substantial problem for the circumstantial stability in view of actual use. Further, in a case where the absolute value for the difference between the exposed potential VL (V) under the high temperature/high humidity circumstance and the exposed potential VL (V) under the low temperature/low humidity circumstance is 60 V or lower in the initial stage and 80 V or lower after fatigue, there is no substantial problem for the circumstantial stability in view of actual use.

TABLE 4

| | Heating method | Residual amount of solvent medium (wt %) | Initial stage 35° C./80% Vo(V) | Initial stage 35° C./80% VL(V) | Initial stage 5° C./20% Vo(V) | Initial stage 5° C./20% VL(V) | After fatigue 35° C./80% Vo(V) | After fatigue 35° C./80% VL(V) | After fatigue 5° C./20% Vo(V) | After fatigue 5° C./20% VL(V) | Evaluation for image quality Initial stage | Evaluation for image quality After fatigue |
|---|---|---|---|---|---|---|---|---|---|---|---|---|
| Example 7 | Far infrared ray | 0.10 | −625 | −74 | −645 | −124 | −618 | −75 | −639 | −135 | A | A |
| Example 8 | Microwave | 0.12 | −628 | −79 | −642 | −130 | −610 | −85 | −638 | −145 | A | A |
| Example 9 | Induction heating | 0.05 | −625 | −75 | −644 | −129 | −612 | −79 | −635 | −142 | A | A |

As can be seen from Table 4, in the electrophotographic photoreceptors manufactured in Examples 7 to 9, the solvent medium inside the light sensitive layer could be entirely dried substantially. The electrophotographic photoreceptors manufactured in Examples 7 to 9 show a small absolute value of 18 V or lower for the difference between the charged potential Vo (V) in the initial stage and the charged potential Vo (V) after fatigue both under the high temperature/high humidity circumstance and under the low temperature/low humidity circumstance. Further, they show a small absolute value of 15 V or lower for the difference between the exposed potential VL (V) and the exposed potential VL (V) after fatigue both under the high temperature/high humidity circumstance and under the low temperature/low humidity circumstance. Accordingly, the electrophotographic light sensitive bodies manufactured in Examples 7 to 9 are excellent in the repetitive stability.

Further, the absolute value for the difference between the charged potential Vo (V) under the high temperature/high humidity circumstance and the charged potential Vo (V) under the low temperature/low humidity circumstance is as small as 28 or lower, and the absolute value for the difference between the exposed potential VL (V) under high temperature/high humidity condition and the exposure potential VL (V) under the low temperature/low humidity circumstance is as small as 20 V or lower in the initial stage and is also as small as 63 V or lower after fatigue. Accordingly, the electrophotographic light sensitive bodies manufactured in Examples 7 to 9 are also excellent in the circumstantial stability.

Further, images formed by photoreceptors manufactured in Examples 7 to 9 were satisfactory being free of image defects such as blanking, black streaks, image blurring.

As has been described above, a photosensitive layer comprising a smooth coating film with no occurrence of pinholes, bubbles and surface unevenness can be formed in a short time by using the method of forming the electrophotographic photoreceptor of the invention. Further, it could be confirmed that the photoreceptor manufactured by the forming method of the invention was excellent in the repetitive stability and the circumstantial stability and could form good images.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of forming an electrophotographic photoreceptor having a conductive substrate and a photosensitive layer, comprising the steps of:

coating a coating solution containing ingredients of the photosensitive layer and a solvent medium containing one or more kinds of solvent on a conductive substrate thereby forming a coating film; and drying the formed coating film by heating by a method selected from the following (1), (2) or (3):

(1) a dielectric heating method, (2) an induction heating method, and (3) two or more of heating methods selected from the group consisting of a far infrared ray heating method, a microwave heating method, a dielectric heating method, and an induction heating method, in an air stream at a temperature of 50° C. or higher and 130° C. or less, wherein the solvent medium contains 30% by weight or more of a solvent having a relative evaporation rate of less than 1.7, where the relative evaporation rate of the solvent is defined as a ratio between a time for evaporating n-butyl acetate and a time for evaporating the solvent.

2. The method of claim 1, wherein the conductive substrate has a circular tubular or columnar shape, and the drying step is conducted while keeping the conductive substrate such that an axial direction thereof is in parallel with the horizontal direction and rotating the conductive substrate about the axial line.

3. The method of claim 1, wherein one or more of factors selected from the group consisting of heating output by the heating method, the temperature of an air stream, and an blowing amount of the air stream is controlled in accordance with the temperature of the coating film.

4. A method of drying a coating film formed by coating a coating solution containing ingredients for the coating film and a solvent medium containing over one or more kinds of a solvent on a substrate, comprising the step of;

drying the formed coating film by heating by a method selected from the following (1), (2) or (3):

(1) a dielectric heating method, (2) an induction heating method, and (3) two or more of heating methods selected from the group consisting of a far infrared ray heating method, a microwave heating method, a dielectric heating method, and an induction heating method, in an air stream at a temperature of 50° C. or higher and 130° C. or less, wherein the solvent medium contains 30% by weight or more of a solvent having a relative evaporation rate of less than 1.7, where the relative evaporation rate of the solvent is defined as a ratio between a time for evaporating n-butyl acetate and a time for evaporating the solvent.

* * * * *